US011594164B2

(12) United States Patent
Lim et al.

(10) Patent No.: US 11,594,164 B2
(45) Date of Patent: Feb. 28, 2023

(54) DISPLAY DEVICE

(71) Applicant: Samsung Display Co., Ltd., Yongin-si (KR)

(72) Inventors: Hyun Jun Lim, Suwon-si (KR); Hyeon Min Kim, Gwacheon-si (KR); Young Wook Yoo, Suwon-si (KR); Jun Gyu Lee, Seoul (KR); Byung Ki Chun, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/513,525

(22) Filed: Oct. 28, 2021

(65) Prior Publication Data

US 2022/0208055 A1 Jun. 30, 2022

(30) Foreign Application Priority Data

Dec. 28, 2020 (KR) ..... 10-2020-0185330

(51) Int. Cl.
*G09G 3/20* (2006.01)

(52) U.S. Cl.
CPC ..... *G09G 3/20* (2013.01); *G09G 2310/08* (2013.01); *G09G 2320/0233* (2013.01); *G09G 2320/0242* (2013.01); *G09G 2320/0257* (2013.01)

(58) Field of Classification Search
CPC ..... G09G 3/20; G09G 2310/08; G09G 2320/0233; G09G 2320/0242; G09G 2320/0257
See application file for complete search history.

(56) References Cited

U.S. PATENT DOCUMENTS

2015/0356898 A1* 12/2015 Jeon ..... G09G 5/008 345/690
2018/0068603 A1* 3/2018 Noh ..... G09G 3/007
2021/0103765 A1* 4/2021 Chun ..... G06V 10/751

FOREIGN PATENT DOCUMENTS

KR 10-2021-0041687 A 4/2021

* cited by examiner

*Primary Examiner* — Kenneth Bukowski

(74) *Attorney, Agent, or Firm* — Lewis Roca Rothgerber Christie LLP

(57) ABSTRACT

A display device includes: a display panel including first and second display areas adjacent to each other; and first and second data drivers configured to drive the first and second display areas, respectively, wherein the first data driver includes: a first afterimage detector configured to receive an input image and to detect a first afterimage area including an afterimage of the first display area from the input image; a first comparator configured to compare an afterimage detection result of the first display area with an afterimage detection result of the second display area received from the second data driver; and a first coordinate corrector configured to correct coordinates of the first afterimage area in response to the afterimage detection result of the first display area and the afterimage detection result of the second display area satisfying a preset reference.

20 Claims, 19 Drawing Sheets

DISPLAY DEVICE

CROSS-REFERENCE TO RELATED APPLICATION

The present application claims priority to and the benefit of Korean Patent Application No. 10-2020-0185330 filed on Dec. 28, 2020, in the Korean Intellectual Property Office, the entire content of which is incorporated herein by reference.

BACKGROUND

1. Field

Aspects of some embodiments of the present disclosure relate to a display device.

2. Description of the Related Art

When a display device displays an image having a fixed image for a considerably long period of time, an afterimage may occur. When the display device displays an image having a fixed image for a considerably long period of time and then displays an image having no fixed image, the area where the fixed image was displayed may display a stain. Therefore, when an afterimage occurs in the display device, display quality may be deteriorated.

The above information disclosed in this Background section is only for enhancement of understanding of the background and therefore the information discussed in this Background section does not necessarily constitute prior art.

SUMMARY

Aspects of some embodiments of the present disclosure include a display device which, when a screen is dividedly driven, precisely detects an afterimage area of an adjacent display area to generate a compensation data voltage corrected for saturation or luminance, thereby preventing or reducing the occurrence of an afterimage, reducing color shift, and improving display quality.

However, aspects of the present disclosure are not restricted to the one set forth herein. The above and other aspects of the present disclosure will become more apparent to one of ordinary skill in the art to which the present disclosure pertains by referencing the detailed description of the present disclosure given below.

According to some embodiments of the present disclosure, a display device comprises: a display panel comprising first and second display areas disposed adjacent to each other, and first and second data drivers configured to drive the first and second display areas, respectively. The first data driver comprises: a first afterimage detection unit configured to receive an input image and detect a first afterimage area including an afterimage of the first display area from the input image, a first comparison unit configured to compare an afterimage detection result of the first display area with an afterimage detection result of the second display area received from the second data driver, and a first coordinate correction unit configured to correct coordinates of the first afterimage area when the afterimage detection result of the first display area and the afterimage detection result of the second display area satisfy a preset reference.

According to some embodiments, the second data driver may comprise: a second afterimage detection unit configured to detect a second afterimage area including an afterimage of the second display area, a second comparison unit configured to compare the afterimage detection result of the second display area with the afterimage detection result of the first display area, and a second coordinate correction unit configured to correct coordinates of the second afterimage area when the afterimage detection result of the second display area and the afterimage detection result of the first display area satisfy a preset reference.

According to some embodiments, the first data driver may transmit the afterimage detection result of the first display area to the second data driver, and may receive the afterimage detection result of the second display area from the second data driver.

According to some embodiments, the display panel may further comprise a third display area adjacent to the second display area. The display device may further comprise a third data driver configured to drive the third display area. The third data driver may comprise: a third afterimage detection unit configured to detect a third afterimage area including an afterimage of the third display area, a third comparison unit configured to compare an afterimage detection result of the third display area with the afterimage detection result of the second display area, and a third coordinate correction unit configured to correct coordinates of the third afterimage area when the afterimage detection result of the third display area and the afterimage detection result of the second display area satisfy a preset reference.

According to some embodiments, the second data driver may further comprise a communication unit configured to determine whether to receive the afterimage detection result from the first data driver and the third data driver. When the second data driver receives the afterimage detection result from each of the first and third data drivers through the communication unit, the second data driver may compare the afterimage detection result of the second display area with the afterimage detection result of each of the first and third display areas.

According to some embodiments, in response to the second data driver not receiving the afterimage detection result from one of the first and third data drivers, the second data driver may compare the afterimage detection result of the second display area with the afterimage detection result received from the other one of the first and third data drivers.

According to some embodiments, the first afterimage detection unit may comprise: a type determination module configured to determine a type of the afterimage in the first afterimage area, an afterimage detection module configured to detect an existence probability of the afterimage in the first afterimage area, and a coordinate detection module configured to detect the coordinates of the first afterimage area.

According to some embodiments, the first comparison unit may comprise: a type comparison module configured to compare the type of the afterimage in the first afterimage area with a type of the afterimage in the second afterimage area, a probability comparison module configured to compare the existence probability of the afterimage in the first afterimage area with an existence probability of the afterimage in the second afterimage area, and a coordinate comparison module configured to compare the coordinates of the first afterimage area with the coordinates of the second afterimage area.

According to some embodiments, the probability comparison module may compare the existence probability of the afterimage in each of the first and second afterimage areas with a preset reference probability, and may compare a difference in the afterimage existence probabilities of the first and second afterimage areas with a preset reference error.

According to some embodiments, the coordinate comparison module may compare at least one of a coordinate difference in a first direction between the first and second afterimage areas, a coordinate difference in a second direction between upper ends of the first and second afterimage areas, or a coordinate difference in the second direction between lower ends of the first and second afterimage areas.

According to some embodiments, the first coordinate correction unit may extend the coordinates in a first direction of the first afterimage area to a boundary line between the first display area and the second display area, and may adjust the coordinates in a second direction of the first afterimage area to an average value of the coordinates in the second direction of the first afterimage area and the coordinates in the second direction of the second afterimage area.

According to some embodiments, the first coordinate correction unit may extend the coordinates in a first direction of the first afterimage area to a boundary line between the first display area and the second display area, and may adjust the coordinates in a second direction of the first afterimage area to a larger value of upper coordinates in the second direction of the first and second afterimage areas, or a smaller value of lower coordinates in the second direction of the first and second afterimage areas.

According to some embodiments, the first afterimage detection unit may detect the number of afterimage pixels in the first display area and coordinates of the afterimage pixels.

According to some embodiments, the first comparison unit may compare a sum of the number of afterimage pixels in a first comparison target area of the first display area and a second comparison target area of the second display area in contact with a boundary line between the first display area and the second display area with a preset reference number.

According to some embodiments, a length of the first comparison target area in the first direction may have a constant value with respect to the boundary line, and a length of the first comparison target area in the second direction may be determined based on upper and lower ends of the first afterimage area and upper and lower ends of the second afterimage area.

According to some embodiments, the first coordinate correction unit may extend the coordinates in a first direction of the first afterimage area to the boundary line.

According to some embodiments of the present disclosure, a display device comprises: a display panel comprising first and second display areas disposed adjacent to each other, and first and second data drivers configured to drive the first and second display areas, respectively. The first data driver comprises: a first afterimage detection unit configured to receive an input image and detect a first afterimage area including an afterimage of the first display area from the input image, a first comparison unit configured to compare a distance between a boundary line between the first display area and the second display area and the first afterimage area with a preset reference distance, and a first coordinate correction unit configured to correct coordinates of the first afterimage area when the distance between the boundary line and the first afterimage area satisfy a preset reference.

According to some embodiments, the second data driver may comprise: a second afterimage detection unit configured to detect a second afterimage area including an afterimage of the second display area, a second comparison unit configured to compare a distance between the boundary line and the second afterimage area with a preset reference distance, and a second coordinate correction unit configured to correct coordinates of the second afterimage area when the distance between the boundary line and the second afterimage area satisfy a preset reference.

According to some embodiments, in response to a distance between the boundary line and the first afterimage area being smaller than a preset reference distance, the first comparison unit may transmit an afterimage correction signal to the first coordinate correction unit.

According to some embodiments, in response to the first coordinate correction unit receiving the afterimage correction signal, the first coordinate correction unit may extend the coordinates of the first afterimage area to the boundary line.

In the display device according to some embodiments, each of a plurality of data drivers may, even when an afterimage area does not include an afterimage adjacent to a boundary line between display areas, correct the afterimage area up to the boundary line. Each of the plurality of data drivers may, even when a display area is dividedly driven, precisely detect an afterimage area of an adjacent display area to generate a compensation data voltage corrected for saturation or luminance. Accordingly, the display device may prevent or reduce the occurrence of an afterimage in the display area, reduce color shift, and improve display quality.

It should be noted that the characteristics of embodiments according to the present disclosure are not limited to those described above, and other characteristics of embodiments according to the present disclosure will be apparent from the following description.

BRIEF DESCRIPTION OF THE DRAWINGS

The above and other aspects and characteristics of embodiments according to the present disclosure will become more apparent by describing in more detail aspects of some embodiments thereof with reference to the attached drawings, in which.

DETAILED DESCRIPTION

Figure 1:
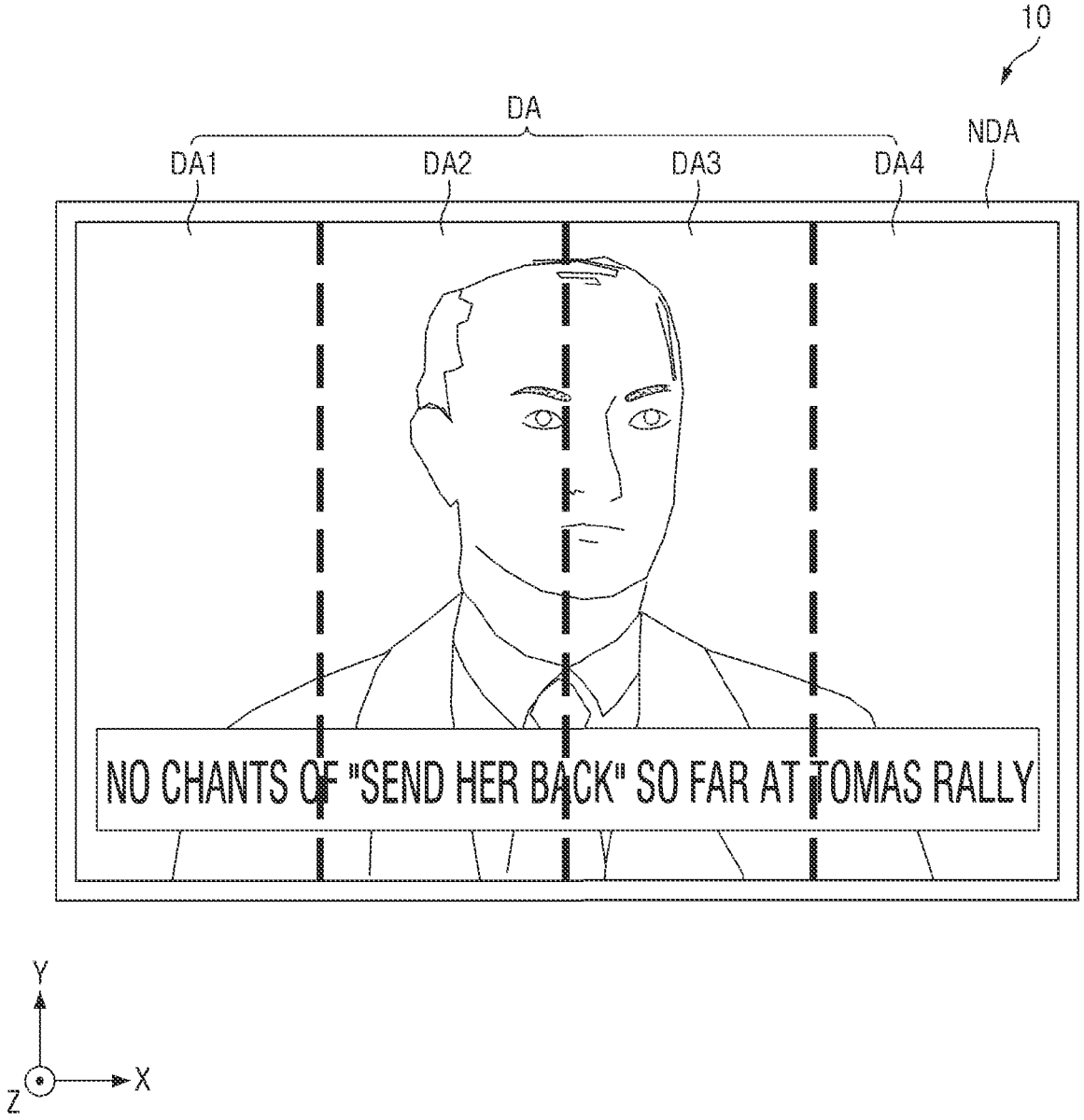
FIG. 1 is a diagram illustrating a screen of a display device according to some embodiments.

In the following description, for the purposes of explanation, numerous details are set forth in order to provide a thorough understanding of various embodiments or implementations of the disclosure. As used herein "embodiments" and "implementations" are interchangeable words that are non-limiting examples of devices or methods employing one or more of the implementations or embodiments disclosed herein. It is apparent, however, that various embodiments may be practiced without these details or with one or more equivalent arrangements. In other instances, structures and devices may be shown in block diagram form in order to avoid unnecessarily obscuring various embodiments. Further, various embodiments may be different, but do not have to be exclusive. For example, shapes, configurations, and characteristics of some embodiments may be used or implemented in other embodiments without departing from the spirit and scope of embodiments according to the disclosure.

Unless otherwise specified, the illustrated embodiments are to be understood as providing features of varying detail of some or a number of ways in which the disclosure may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the disclosure.

The use of cross-hatching and/or shading in the accompanying drawings is generally provided to clarify boundaries between adjacent elements. As such, neither the presence nor the absence of cross-hatching or shading conveys or indicates any preference or requirement for materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the X-axis, the Y-axis, and the Z-axis are not limited to three axes of a rectangular coordinate system, such as the x, y, and z axes, and may be interpreted in a broader sense. For example, the X-axis, the Y-axis, and the Z-axis may be substantially perpendicular to one another, or may represent different directions that may not be perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

The terms "and" and "or" may be used in the conjunctive or disjunctive sense and may be understood to be equivalent to "and/or."

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (for example, as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (for example, rotated 90 degrees or about 90 degrees or at other orientations), and, as such, the spatially relative descriptors used herein interpreted accordingly.

The terms "overlap" or "overlapped" mean that a first object may be above or below or to a side of a second object, and vice versa. Additionally, the term "overlap" may include layer, stack, face or facing, extending over, covering, or partly covering or any other suitable term as would be appreciated and understood by those of ordinary skill in the art.

When an element is described as 'not overlapping' or 'to not overlap' another element, this may include that the elements are spaced apart from each other, offset from each other, or set aside from each other or any other suitable term as would be appreciated and understood by those of ordinary skill in the art.

The terms "face" and "facing" mean that a first element may directly or indirectly oppose a second element. In a case in which a third element intervenes between the first and second element, the first and second element may be understood as being indirectly opposed to one another, although still facing each other.

The terminology used herein is for the purpose of describing embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," "has," and/or "having," and/or variations thereof when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

For example, "about" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

Various embodiments are described herein with reference to sectional and/or exploded illustrations that are schematic illustrations of embodiments and/or intermediate structures. As such, variations from the shapes of the illustrations as a result, for example, of manufacturing techniques and/or tolerances, are to be expected. Thus, embodiments disclosed herein should not necessarily be construed as limited to the illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

Some or a number of embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (for example, microcode) to perform various functions discussed herein and may optionally be driven by firmware and/or software. It is also contemplated that each block, unit, and/or module may be implemented by dedicated hardware, or as a combination of dedicated hardware to perform some or a number of functions and a processor (for example, one or more programmed microprocessors and associated circuitry) to perform other functions. Also, each block, unit, and/or module of some or a number of embodiments may be physically separated into two or more interacting and discrete blocks, units, and/or modules without departing from the scope of the disclosure. Further, the blocks, units, and/or modules of some or a number of embodiments may be physically combined into more complex blocks, units, and/or modules without departing from the scope of the disclosure.

Unless otherwise defined, all terms (including technical and scientific terms) used herein have the same meaning as commonly understood by one of ordinary skill in the art to which this disclosure pertains. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
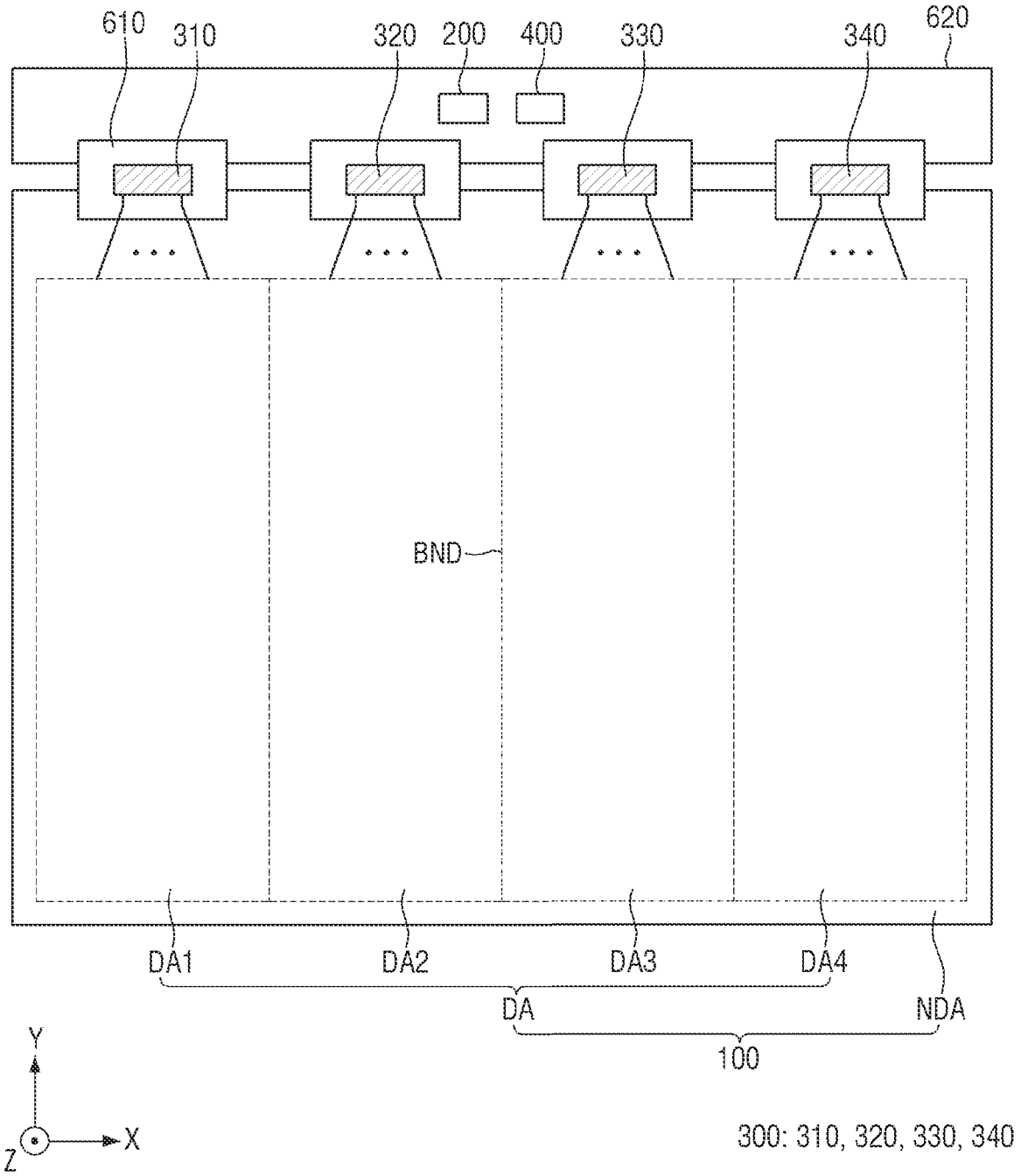
FIG. 2 is a plan view illustrating a display device according to some embodiments.
Figure 3:
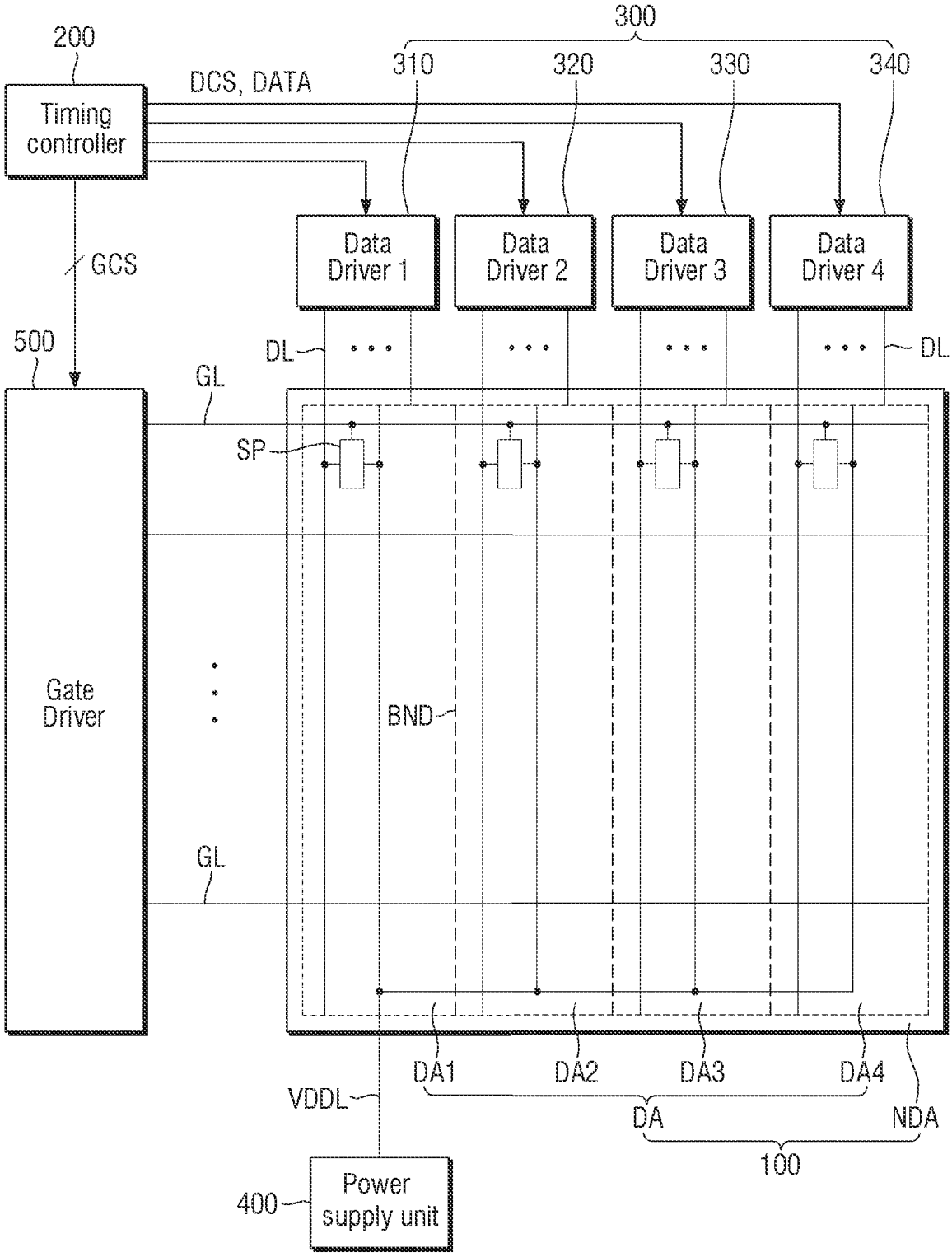
FIG. 3 is a block diagram illustrating a display device according to some embodiments.

FIG. 1 is a diagram illustrating a screen of a display device according to some embodiments. FIG. 2 is a plan view illustrating a display device according to some embodiments. FIG. 3 is a block diagram illustrating a display device according to some embodiments.

Referring to FIGS. 1 to 3, a display device 10 is a device that displays a moving image (e.g., video images) or a still image (e.g., static images), and may be used as a display screen for various electronic devices or products such as a television, a laptop, a monitor, a billboard, an Internet of Things (IoT) device, or any other suitable electronic device configured to display graphical information or images.

The display device 10 may include a display panel 100, a timing controller 200, a data driver 300, a power supply unit (or power supply) 400, a gate driver 500, a plurality of flexible films 610, and/or a circuit board 620.

The display panel 100 may have a rectangular shape in a plan view (e.g., a view perpendicular or normal with respect to a display surface of the display panel). For example, the display panel 100 may have a rectangular shape, in a plan view, having long sides in a first direction (X-axis direction) and short sides in a second direction (Y-axis direction) perpendicular to the first direction (X-axis direction). A corner formed by the long side in the first direction (X-axis direction) and the short side in the second direction (Y-axis direction) may be right-angled or rounded with a curvature (e.g., a set or predetermined curvature). The planar shape of the display panel 100 is not limited to the rectangular shape, and may be formed in another polygonal shape, a circular shape or an elliptical shape. For example, the display panel 100 may be formed to be flat, but embodiments according to the present disclosure are not limited thereto. In another example, the display panel 100 may be bent with a curvature (e.g., a set or predetermined curvature).

The display panel 100 may include a display area DA and a non-display area NDA.

The display area DA, which is an area for displaying an image, may be defined as the central area of the display panel 100. The display area DA may include a plurality of pixels SP formed in pixel areas defined by a plurality of data lines DL and a plurality of gate lines. Each of the plurality of pixels SP may be connected to at least one gate line GL, a data line DL, and a driving voltage line VDDL. Each of the plurality of pixels SP may be defined as an area of the smallest unit that outputs light.

The display area DA may include the first to fourth display areas DA1, DA2, DA3, and DA4. The first to fourth display areas DA1, DA2, DA3, and DA4 may be arranged along the first direction (X-axis direction), but embodiments are not limited thereto. The first to fourth display areas DA1, DA2, DA3, and DA4 may be driven by first to fourth data drivers 310, 320, 330, and 340, respectively. The first to fourth display areas DA1, DA2, DA3, and DA4 may be divided based on a boundary line BND. Additionally, although four display areas are illustrated in FIGS. 1-3 as an example, embodiments are not limited thereto, and according to some embodiments there may be more than four display areas, or fewer than four display areas, without departing from the spirit and scope of embodiments according to the present disclosure.

The plurality of gate lines GL may be connected between the gate driver 500 and the plurality of pixels SP. The plurality of gate lines GL may supply gate signals to each of the plurality of pixels SP. The plurality of gate lines GL may extend in the first direction (X-axis direction) and may be spaced apart from each other in the second direction (Y-axis direction).

The plurality of data lines DL may be connected between the data driver 300 and the plurality of pixels SP. The plurality of data lines DL may supply a data voltage to each of the plurality of pixels SP. The plurality of data lines DL may extend in the second direction (Y-axis direction) and may be spaced apart from each other in the first direction (X-axis direction).

A plurality of driving voltage lines VDDL may be connected between the power supply unit 400 and the plurality of pixels SP. The plurality of driving voltage lines VDDL may supply a driving voltage to each of the plurality of pixels SP. The plurality of driving voltage lines VDDL may extend in the second direction (Y-axis direction) and may be spaced apart from each other in the first direction (X-axis direction).

The non-display area NDA may be defined as the remaining area of the display panel 100 except the display area DA. For example, the non-display area NDA may include the gate driver 500 which applies gate signals to the gate lines GL, fan-out lines which connect the data lines DL to the data driver 300, and a pad portion connected to the flexible film. For another example, the gate driver 500 may be incorporated in the data driver 300.

The timing controller 200 may receive a timing synchronization signal and image data from a display driving system. The timing controller 200 may generate a data control signal DCS and a gate control signal GCS based on the timing synchronization signal. The timing controller 200 may control the driving timing of the data driver 300 using the data control signal DCS, and control the driving timing of the gate driver 500 using the gate control signal GCS. The timing controller 200 may generate pixel data DATA based on the image data, align the pixel data DATA to fit the arrangement structure of the pixels SP, and supply it to the first to fourth data drivers 310, 320, 330, and 340.

The data driver 300 may receive the data control signal DCS and the pixel data DATA from the timing controller 200. The data driver 300 may include the first to fourth data drivers 310, 320, 330, and 340. The first to fourth data drivers 310, 320, 330, and 340 may drive the first to fourth display areas DA1, DA2, DA3, and DA4, respectively. The first to fourth data drivers 310, 320, 330, and 340 may generate data voltages based on the pixel data DATA, and supply the data voltages to the first to fourth display areas DA1, DA2, DA3, and DA4, respectively, according to the data control signal DCS. The data voltage may be supplied to the plurality of pixels SP through the data line DL to determine the luminance of the plurality of pixels SP. The display device 10 may easily perform high-resolution driving by dividing the display area DA by using the plurality of data drivers 300.

The power supply unit 400 may supply a power voltage to the plurality of pixels SP. The power supply unit 400 may generate the driving voltage and supply the driving voltage to the plurality of pixels SP arranged on the display panel 100 through the driving voltage line VDDL. The power supply unit 400 may generate a common voltage and supply the common voltage to a low potential line of the display panel 100. For example, the driving voltage may correspond to a high potential voltage capable of driving the plurality of pixels SP, and the common voltage may correspond to a low potential voltage commonly supplied to the plurality of pixels SP.

The gate driver 500 may generate a gate signal based on the gate control signal GCS supplied from the timing controller 200, and supply the gate signal sequentially to the plurality of gate lines GL according to a preset order. For example, the gate driver 500 may be provided in the non-display area NDA of the display panel 100. For another example, the gate driver 500 may be incorporated in the data driver 300.

The plurality of flexible films 610 may mount the plurality of data driver 300, and may connect the circuit board 620 to the pad portion of the display panel 100. The input terminals located on one side of the flexible film 610 may be attached to the circuit board 620 by a film adhesion process, and the output terminals located on the other side of the flexible film 610 may be attached to the pad portion of the display panel 100 by the film adhesion process. For example, the flexible film 610 may be a flexible film that can be bent, such as a tape carrier package or a chip on film. For example, the flexible film 610 may be bent toward the lower portion of the display panel 100 to reduce the bezel area of the display device, although not limited thereto.

The circuit board 620 may support the timing controller 200 and the power supply unit 400 and supply various signals and power to the data driver 300. For example, the circuit board 620 may supply the signal supplied from the timing controller 200 and the source voltage supplied from the power supply unit 400 to the data driver 300 and the gate driver 500 in order to display an image on each pixel. To this end, a signal line and a plurality of power lines may be provided on the circuit board 620.

Figure 4:
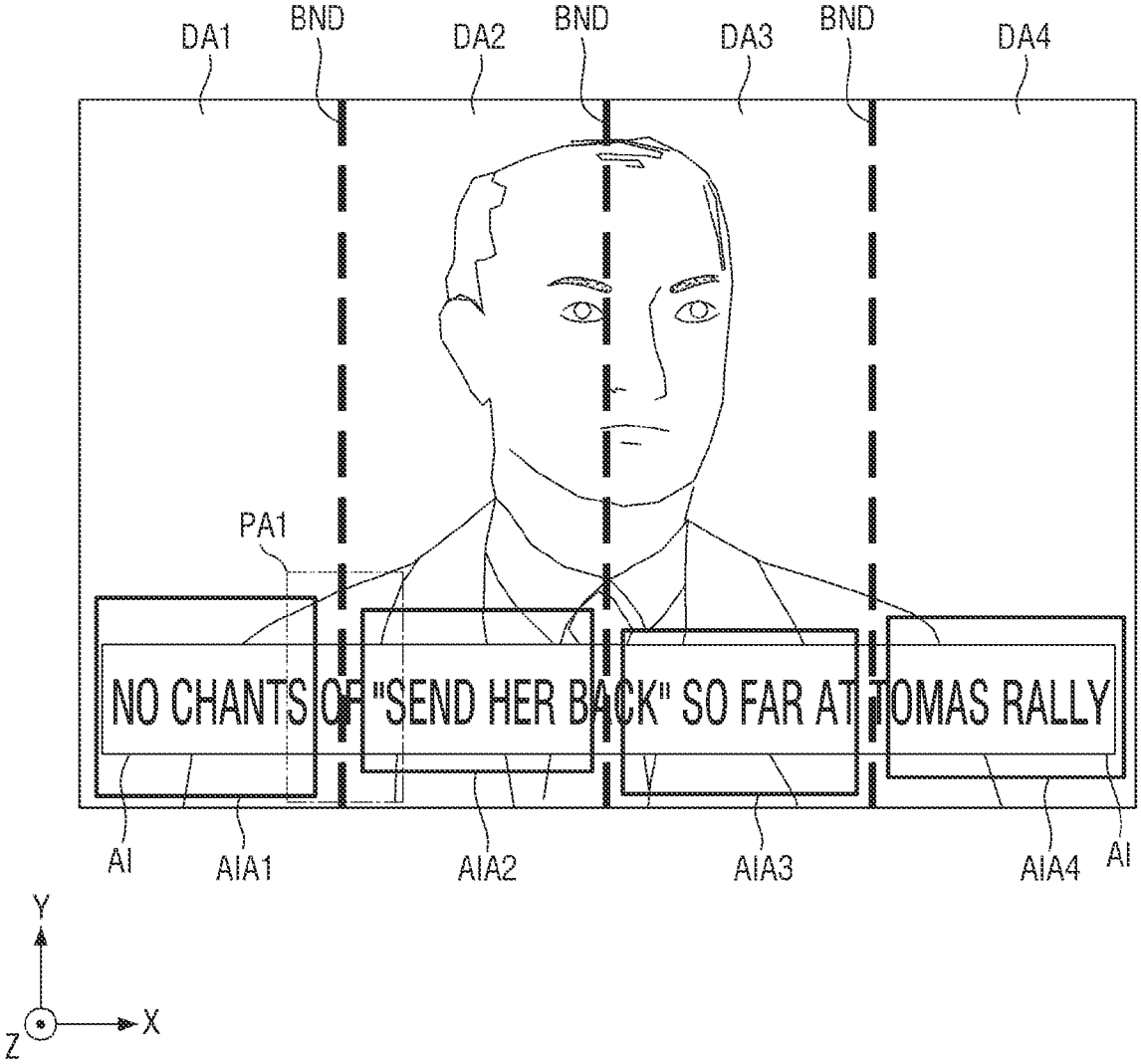
FIG. 4 is a diagram illustrating first to fourth display areas in a display device according to some embodiments.

FIG. 4 is a diagram illustrating first to fourth display areas in a display device according to some embodiments.

Referring to FIG. 4, the first to fourth display areas DA1, DA2, DA3, and DA4 may divide one image and display it. When an image includes a caption, a logo, or a banner, the first to fourth display areas DA1, DA2, DA3, and DA4 may display the image having a fixed image for a considerably long period of time. The image fixed for a considerably long period of time may cause an afterimage AI or stain in the first to fourth display areas DA1, DA2, DA3, and DA4.

The first to fourth data drivers 310, 320, 330, and 340 may receive an input image, and detect first to fourth afterimage areas AIA1, AIA2, AIA3, and AIA4 including the afterimages AI of the first to fourth display areas DA1, DA2, DA3, and DA4 in the input image. For example, the first to fourth afterimage areas AIA1, AIA2, AIA3, and AIA4 may have different shapes, but embodiments are not limited thereto.

The first data driver 310 may drive the first display area DA1 to prevent or reduce the occurrence of the afterimage in the first display area DA1. The first data driver 310 may detect the first afterimage area AIA1 including the afterimage AI in the first display area DA1. The first afterimage area AIA1 may not include the afterimage AI adjacent to the boundary line BND between the first display area DA1 and the second display area DA2. The first data driver 310 may compare the afterimage detection results of the first to fourth display areas DA1, DA2, DA3, and DA4 to correct the coordinates of the first afterimage area AIA1. The first data driver 310 may adjust the luminance of the corrected afterimage area to generate a compensation data voltage. Accordingly, the first data driver 310 may prevent or reduce the occurrence of the afterimage in the first display area DA1, reduce color shift, and improve the display quality.

The second to fourth data drivers 320, 330, and 340 may prevent or reduce the occurrence of the afterimage of the second to fourth display areas DA2, DA3, and DA4, respectively. Hereinafter, the operation of the first data driver 310 will be mainly described, and some redundant configurations of the second to fourth data drivers 320, 330, and 340 will be briefly described or may be omitted.

Figure 5:
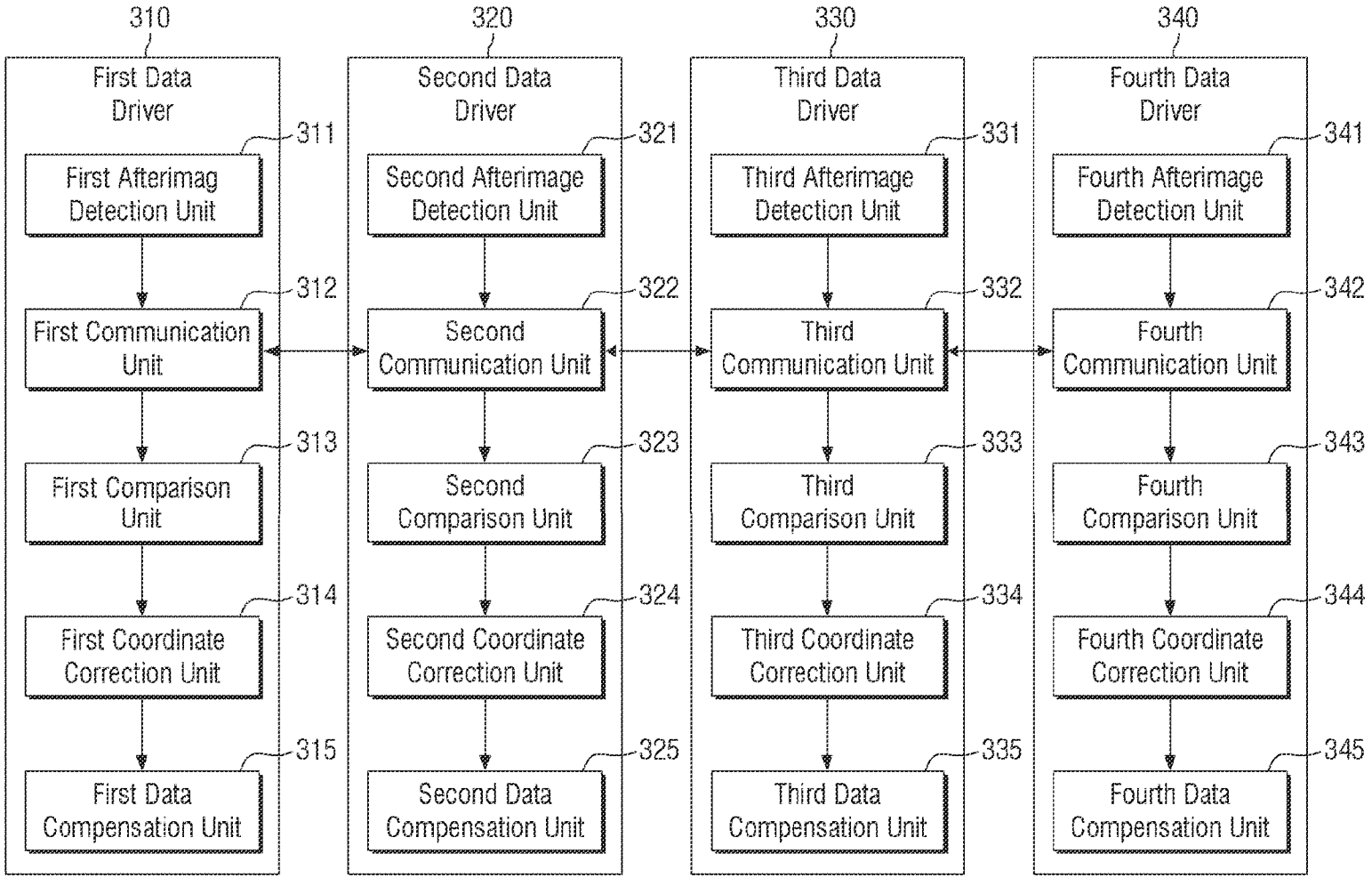
FIG. 5 is a block diagram illustrating first to fourth data drivers in a display device according to some embodiments.
Figure 6:
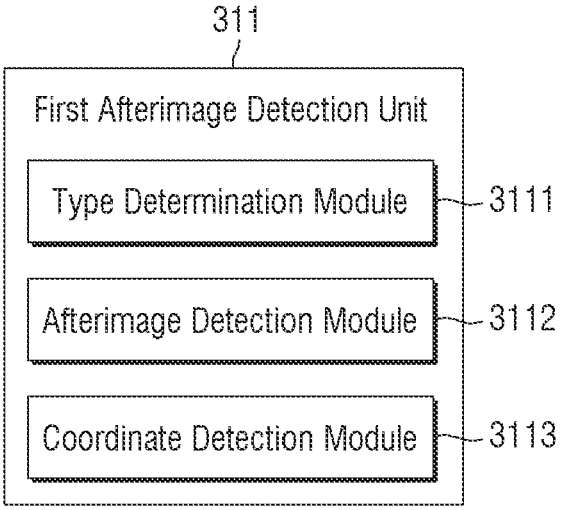
FIG. 6 is a block diagram illustrating a first afterimage detection unit in a display device according to some embodiments.
Figure 7:
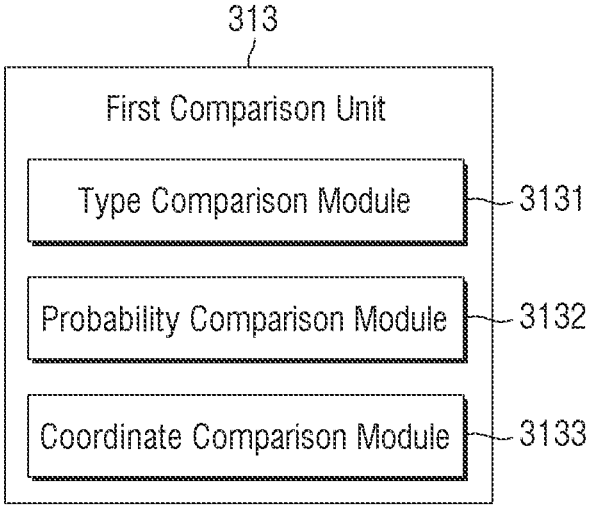
FIG. 7 is a block diagram illustrating a first comparison unit in a display device according to some embodiments.
Figure 8:
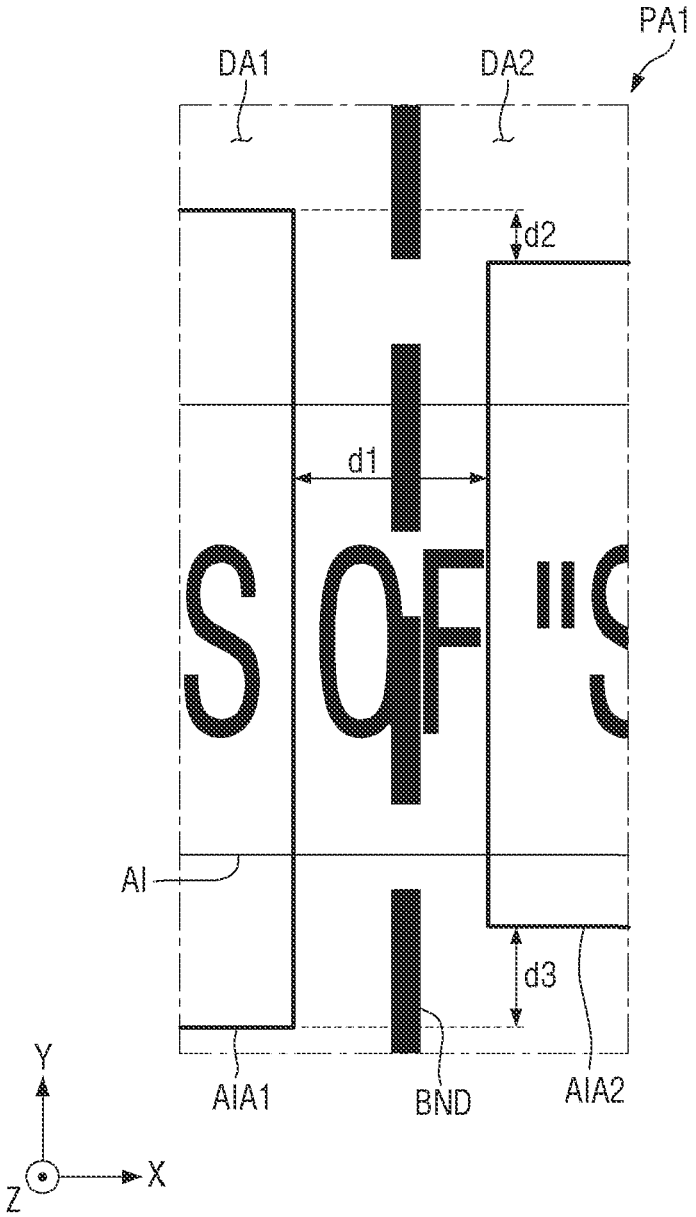
FIG. 8 is an enlarged view of region PA1 of FIG. 4.
Figure 9:
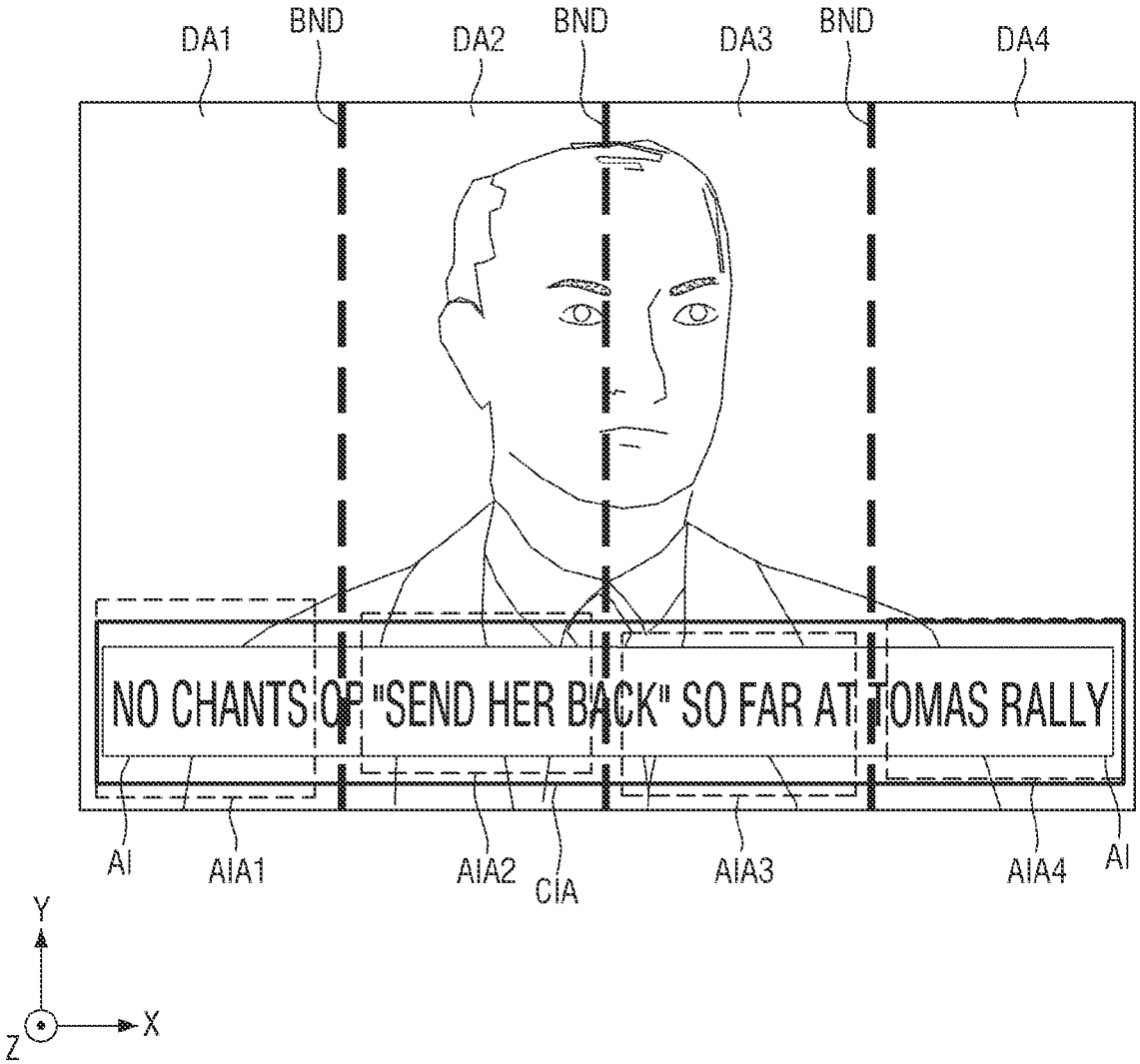
FIG. 9 is a diagram illustrating a corrected afterimage area in a display device according to some embodiments.

FIG. 5 is a block diagram illustrating first to fourth data drivers in a display device according to some embodiments. FIG. 6 is a block diagram illustrating a first afterimage detection unit (or first afterimage detector) in a display device according to some embodiments. FIG. 7 is a block diagram illustrating a first comparison unit (or first comparator) in a display device according to some embodiments. FIG. 8 is an enlarged view of region PA1 of FIG. 4. FIG. 9 is a diagram illustrating a corrected afterimage area in a display device according to some embodiments.

Referring to FIGS. 5 to 9, the data driver 300 may include the first to fourth data drivers 310, 320, 330, and 340.

The first data driver 310 may include a first afterimage detection unit (or first afterimage detector) 311, a first communication unit (or first communicator) 312, a first comparison unit (or first comparator) 313, a first coordinate correction unit (or first corrector) 314, and a first data compensation unit (or first data compensator) 315. The second data driver 320 may include a second afterimage detection unit (or second afterimage detector) 321, a second communication unit (or second communicator) 322, a second comparison unit (or second comparator) 323, a second coordinate correction unit (or second coordinate corrector) 324, and a second data compensation unit (or second data compensator) 325. The third data driver 330 may include a third afterimage detection unit (or third afterimage detector) 331, a third communication unit (or third communicator) 332, a third comparison unit (or third comparator) 333, a third coordinate correction unit (or third coordinate corrector) 334, and a third data compensation unit (or third data compensator) 335. The fourth data driver 340 may include a fourth afterimage detection unit (or fourth afterimage detector) 341, a fourth communication unit (or fourth communicator) 342, a fourth comparison unit (or fourth comparator) 343, a fourth coordinate correction unit (or fourth coordinate corrector) 344, and a fourth data compensation unit (or fourth data compensator) 345. Hereinafter, the operation of the first data driver 310 will be mainly described, and redundant configurations of the second to fourth data drivers 320, 330, and 340 will be briefly described or omitted.

The first afterimage detection unit 311 may receive an input image and detect the first afterimage area AIA1 including the afterimage AI in the first display area DA1. The afterimage AI of the input image may be generated when the input image has a fixed image for a considerably long period of time. The first afterimage detection unit 311 may detect the afterimage AI using at least one of a convolutional neural network technique, a deep learning technique, or an artificial intelligence technique, and may define the first afterimage area AIA1 including an area in which the afterimage AI is displayed. For example, the first afterimage detection unit 311 may analyze a histogram of grayscale data of the input image and may detect the afterimage AI based on a difference value of the histogram. For another example, the first afterimage detection unit 311 may detect the afterimage AI based on a hue, a saturation, and a value of grayscale data of the input image. An afterimage detection technique of the first afterimage detection unit 311 is not limited to the above-described techniques, and the first afterimage detection unit 311 may distinguish between an image that is fixed for a plurality of frames and an image that changes for each frame in an input image.

The first afterimage detection unit 311 may include a type determination module 3111, an afterimage detection module 3112, and a coordinate detection module 3113.

The type determination module 3111 may determine the type of the afterimage AI in the first afterimage area AIA1. The type determination module 3111 may determine the type of the afterimage AI using a preset algorithm. The type determination module 3111 may determine the type of the afterimage AI based on at least one of the location, duration, shape, size, or display content of the afterimage AI. For example, the type determination module 3111 may determine whether the afterimage AI in the first afterimage area AIA1 corresponds to a caption, a logo, or a banner.

The afterimage detection module 3112 may detect the probability of the existence of the afterimage AI in the first afterimage area AIA1. For example, the existence probability of the afterimage AI may correspond to a pixel size of an area in which the afterimage AI is displayed from a pixel size of the first afterimage area AIA1. As the first afterimage area AIA1 and the area in which the afterimage AI is displayed coincide, the existence probability of the afterimage AI may increase. As the existence probability of the afterimage AI increases, the reliability of the first afterimage area AIA1 may increase.

The coordinate detection module 3113 may detect the coordinates of the first afterimage area AIA1. The coordinate detection module 3113 may detect the coordinates of the first afterimage area AIA1 in the first direction (X-axis direction) and in the second direction (Y-axis direction). The coordinate detection module 3113 may define the first afterimage area AIA1 by detecting the coordinates of a plurality of sides of the first afterimage area AIA1.

The first afterimage detection unit 311 may provide the afterimage detection result to the first communication unit 312. The first afterimage detection unit 311 may provide the first communication unit 312 with the type of the afterimage AI of the first afterimage area AIA1 determined by the type determination module 3111, the existence probability of the afterimage AI detected by the afterimage detection module 3112, and the coordinates of the first afterimage area AIA1 detected by the coordinate detection module 3113.

The first communication unit 312 may perform wired or wireless communication with each of the second to fourth communication units 322, 332, and 342. The first communication unit 312 may transmit the afterimage detection result of the first afterimage area AIA1 to each of the second to fourth communication units 322, 332, and 342, and may receive the afterimage detection result of each of the second to fourth afterimage areas AIA2, AIA3, and AIA4 from the second to fourth communication units 322, 332, and 342. The first communication unit 312 may determine whether or not the second to fourth data drivers 320, 330, and 340 respectively including the second to fourth communication units 322, 332, and 342 operate or not based on whether the afterimage detection results are received.

For example, when the first communication unit 312 receives the afterimage detection result of the second afterimage area AIA2 from the second communication unit 322, the first communication unit 312 may determine that the second data driver 320 operates. In this case, the first communication unit 312 may transmit the afterimage detection results of the first and second display areas DA1 and DA2 to the first comparison unit 313.

When the first communication unit 312 receives the afterimage detection results of the second and third afterimage areas AIA2 and AIA3 from the second and third communication units 322 and 332, the first communication unit 312 may determine that the second and third data drivers 320 and 330 operate. In this case, the first communication unit 312 may transmit the afterimage detection results of the first to third display areas DA1, DA2, and DA3 to the first comparison unit 313.

When the first communication unit 312 receives the afterimage detection results of the second to fourth afterimage areas AIA2, AIA3, and AIA4 from the second to fourth communication units 322, 332, and 342, the first communication unit 312 may determine that the second to fourth data drivers 320, 330, and 340 operate. In this case, the first communication unit 312 may transmit the afterimage detection results of the first to fourth display areas DA1, DA2, DA3, and DA4 to the first comparison unit 313.

When the first communication unit 312 does not receive the afterimage detection result of the second afterimage area AIA2 from the second communication unit 322, the first communication unit 312 may determine that the second data driver 320 does not operate. In this case, the first communication unit 312 may transmit the afterimage detection result of only the first display area DA1 to the first comparison unit 313, regardless of whether the afterimage detection results of the third and fourth display areas DA3 and DA4 have been received or not.

When the first communication unit 312 receives the afterimage detection result of the second afterimage area AIA2 from the second communication unit 322 and does not receive the afterimage detection result of the third afterimage area AIA3 from the third communication unit 332, the first communication unit 312 may determine that the second data driver 320 operates and the third data driver 330 does not operate. In this case, the first communication unit 312 may transmit the afterimage detection results of the first and second display areas DA1 and DA2 to the first comparison unit 313, regardless of whether the afterimage detection result of the fourth display area DA4 is received.

Accordingly, the first communication unit 312 may determine whether or not the third communication unit 332 operates or not based on whether the second communication unit 322 closest thereto operates or not, and may determine whether or not the fourth communication unit 332 operates or not based on whether the third communication unit 332 operates or not. With respect to a display area (the second display area, or the second and third display areas, or the second to fourth display areas) adjacent to the first display area DA1, the first data driver 310 may correct the coordinates of the corresponding afterimage area and generate a compensation data voltage. Even when the display area DA is dividedly driven, the first data driver 310 may precisely detect an afterimage area of an adjacent display area to generate a compensation data voltage corrected for saturation or luminance.

The first comparison unit 313 may compare the afterimage detection results received from the first communication unit 312. For example, when receiving the afterimage detection results of the first and second display areas DA1 and DA2 from the first communication unit 312, the first comparison unit 313 may compare the afterimage detection results of the first and second display areas DA1 and DA2. For another example, when receiving the afterimage detection results of the first to fourth display areas DA1, DA2, DA3, and DA4 from the first communication unit 312, the first comparison unit 313 may compare the afterimage detection results of the first to fourth display areas DA1, DA2, DA3, and DA4.

The first comparison unit 313 may include a type comparison module 3131, a probability comparison module 3132, and a coordinate comparison module 3133.

The type comparison module 3131 may compare the types of the afterimages AI in the first to fourth afterimage areas AIA1, AIA2, AIA3, and AIA4. The afterimage AI in each of the first to fourth afterimage areas AIA1, AIA2, AIA3, and AIA4 may correspond to a caption, a logo, or a banner. The type comparison module 3131 may determine whether the types of the afterimages AI in the first to fourth afterimage areas AIA1, AIA2, AIA3, and AIA4 are identical or not. When the types of the afterimages AI in the first to fourth afterimage areas AIA1, AIA2, AIA3, and AIA4 are the same, the type comparison module 3131 may provide a type coincidence signal to the probability comparison module 3132. In this case, the probability comparison module 3132 may compare the afterimage existence probabilities of the first to fourth afterimage areas AIA1, AIA2, AIA3, and AIA4.

For another example, when the types of the afterimages AI in the first and second afterimage areas AIA1 and AIA2 are the same and the type of the afterimage AI in the third afterimage area AIA3 is different, the type comparison module 3131 may provide a type coincidence signal for the second afterimage area AIA2 to the probability comparison module 3132. In this case, the probability comparison module 3132 may compare the afterimage existence probabilities of the first and second afterimage areas AIA1 and AIA2.

For still another example, when the types of the afterimages AI in the first and second afterimage areas AIA1 and AIA2 are different, the type comparison module 3131 may provide an afterimage non-coincidence signal to the first coordinate correction unit 314. In this case, the first coordinate correction unit 314 may correct the coordinates of the first afterimage area AIA1 based on the afterimage detection result of the first afterimage area AIA1.

The probability comparison module 3132 may detect the afterimage existence probability in each of the first to fourth afterimage areas AIA1, AIA2, AIA3, and AIA4. The probability comparison module 3132 may compare the afterimage existence probability in each of the first to fourth afterimage areas AIA1, AIA2, AIA3, and AIA4 with a preset reference probability. For example, the probability comparison module 3132 may determine whether the afterimage existence probability in each of the first to fourth afterimage areas AIA1, AIA2, AIA3, and AIA4 is 0.75 or more, but the reference probability is not limited thereto.

When the afterimage existence probability in each of the first to fourth afterimage areas AIA1, AIA2, AIA3, and AIA4 is greater than or equal to the reference probability, the probability comparison module 3132 may compare a difference in the afterimage existence probabilities of the first to fourth afterimage areas AIA1, AIA2, AIA3, and AIA4 with a preset reference error. For example, the probability comparison module 3132 may determine whether the difference in the afterimage existence probabilities of the first to fourth afterimage areas AIA1, AIA2, AIA3, and AIA4 is 0.05 or less, but the reference error is not limited thereto. When the difference in the afterimage existence probabilities of the first to fourth afterimage areas AIA1, AIA2, AIA3, and AIA4 is less than or equal to the reference error, the probability comparison module 3132 may provide a probability similar signal to the coordinate comparison module 3133.

For another example, when the afterimage existence probability of at least one of the first to fourth afterimage areas AIA1, AIA2, AIA3, or AIA4 is less than the reference probability, the probability comparison module 3132 may provide an afterimage non-coincidence signal for the corresponding afterimage area to the first coordinate correction unit 314. In addition, when a difference in the afterimage existence probabilities of at least one of the first to fourth afterimage areas AIA1, AIA2, AIA3, or AIA4 exceeds the reference error, the probability comparison module 3132 may provide an afterimage non-coincidence signal for the corresponding afterimage area to the first coordinate correction unit 314.

The coordinate comparison module 3133 may compare the coordinates of the first to fourth afterimage areas AIA1, AIA2, AIA3, and AIA4. The coordinate comparison module 3133 may obtain a coordinate difference in the first direction (X-axis direction) between adjacent afterimage areas in the first to fourth afterimage areas AIA1, AIA2, AIA3, and AIA4. The coordinate comparison module 3133 may obtain a coordinate difference in the second direction (Y-axis direction) between the upper ends of the first to fourth afterimage areas AIA1, AIA2, AIA3, and AIA4, and may obtain a coordinate difference in the second direction (Y-axis direction) between the lower ends of the first to fourth afterimage areas AIA1, AIA2, AIA3, and AIA4.

In FIG. 8, the coordinate comparison module 3133 may obtain a coordinate difference d1 in the first direction (X-axis direction) between the first and second afterimage areas AIA1 and AIA2. The coordinate comparison module 3133 may obtain a coordinate difference d2 in the second direction (Y-axis direction) between the upper ends of the first and second afterimage areas AIA1 and AIA2, and may obtain a coordinate difference d3 in the second direction (Y-axis direction) between the lower ends of the first and second afterimage areas AIA1 and AIA2.

For example, when a coordinate difference in the first direction (X-axis direction) between adjacent afterimage areas, a coordinate difference in the second direction (Y-axis direction) between the upper ends of the first to fourth afterimage areas AIA1, AIA2, AIA3, and AIA4, and a coordinate difference in the second direction (Y-axis direction) between the lower ends of the first to fourth afterimage areas AIA1, AIA2, AIA3, and AIA4 are less than or equal to the reference error, the coordinate comparison module 3133 may determine that the coordinate difference between the first to fourth afterimage areas AIA1, AIA2, AIA3, and AIA4 is less than or equal to the reference error. Here, the reference error of the coordinates may correspond to 3% of the resolution, but is not limited thereto.

For another example, when at least one of a coordinate difference in the first direction (X-axis direction) between adjacent afterimage areas, a coordinate difference in the second direction (Y-axis direction) between the upper ends of the first to fourth afterimage areas AIA1, AIA2, AIA3, and AIA4, or a coordinate difference in the second direction (Y-axis direction) between the lower ends of the first to fourth afterimage areas AIA1, AIA2, AIA3, and AIA4 exceeds the reference error, the coordinate comparison module 3133 may determine that the coordinate difference between the corresponding afterimage areas exceeds the reference error. In this case, the coordinate comparison module 3133 may provide the first coordinate correction unit 314 with an afterimage coincidence signal for the afterimage areas whose coordinate difference is less than or equal to the reference error. The coordinate comparison module 3133 may provide the first coordinate correction unit 314 with an afterimage non-coincidence signal for at least one afterimage area whose coordinate difference exceeds the reference error.

The first coordinate correction unit 314 may correct the coordinates of the first afterimage area AIA1 based on the afterimage coincidence signal received from the first comparison unit 313. The first coordinate correction unit 314 may provide the coordinates of a corrected afterimage area CIA to the first data compensation unit 315.

For example, when receiving the afterimage coincidence signal of the first to fourth afterimage areas AIA1, AIA2, AIA3, and AIA4 from the first comparison unit 313, the first coordinate correction unit 314 may extend the coordinates in the first direction (X-axis direction) of the first afterimage area AIA1 to the boundary line BND, and may correct the coordinates in the second direction (Y-axis direction) of the first afterimage area AIA1 to an average value of the coordinates in the second direction (Y-axis direction) of the first to fourth afterimage areas AIA1, AIA2, AIA3, and AIA4. For another example, the first coordinate correction unit 314 may correct the coordinates in the second direction (Y-axis direction) of the first afterimage area AIA1 to the largest value or the smallest value among the coordinates in the second direction (Y-axis direction) of the first to fourth afterimage areas AIA1, AIA2, AIA3, and AIA4.

For example, when receiving the afterimage coincidence signal of the first and second afterimage areas AIA1 and AIA2 from the first comparison unit 313, the first coordinate correction unit 314 may extend the coordinates in the first direction (X-axis direction) of the first afterimage area AIA1 to the boundary line BND, and may correct the coordinates in the second direction (Y-axis direction) of the first afterimage area AIA1 to an average value of the coordinates in the second direction (Y-axis direction) of the first and second afterimage areas AIA1 and AIA2. For another example, the first coordinate correction unit 314 may correct the coordinates in the second direction (Y-axis direction) of the first afterimage area AIA1 to the largest value or the smallest value among the coordinates in the second direction (Y-axis direction) of the first and second afterimage areas AIA1 and AIA2.

The first data compensation unit 315 may generate a compensation data voltage by adjusting the saturation or luminance of the corrected afterimage area CIA. Accordingly, even when the first afterimage area AIA1 does not include the afterimage AI adjacent to the boundary line BND between the first and second display areas DA1 and DA2, the first data driver 310 may correct the first afterimage area AIA1 up to the boundary line BND. Even when the display area DA is dividedly driven, the first data driver 310 may precisely detect an afterimage area of an adjacent display area to generate a compensation data voltage corrected for saturation or luminance. The first data driver 310 may prevent or reduce the occurrence of the afterimage in the first display area DA1, reduce color shift, and improve the display quality.

Figure 10:
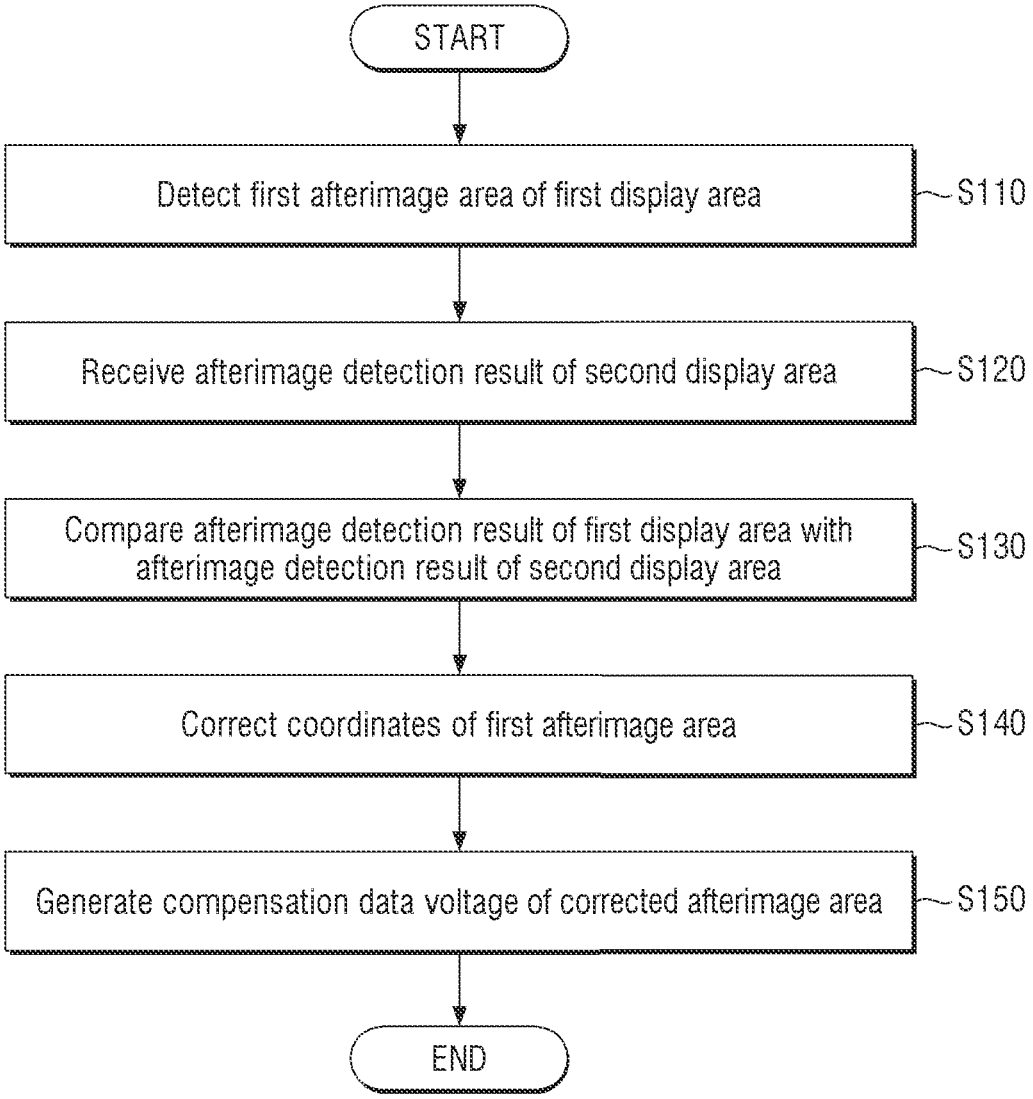
FIG. 10 is a flowchart illustrating an afterimage processing process of a first data driver in a display device according to some embodiments.

FIG. 10 is a flowchart illustrating an afterimage processing process of a first data driver in a display device according to some embodiments. Embodiments according to the present disclosure are not limited to the number or order of operations illustrated in FIG. 10, however. For example, according to some embodiments, there may be additional operations, or fewer operations, or the order of the operations may vary from what is illustrated in FIG. 10, without departing from the spirit and scope of embodiments according to the present disclosure. The afterimage processing process of FIG. 10 corresponds to a case where the first data driver 310 receives the afterimage detection result from the second data driver 320 among the second to fourth data drivers 320, 330, and 340.

Referring to FIG. 10, the first data driver 310 may include the first afterimage detection unit 311, the first communication unit 312, the first comparison unit 313, the first coordinate correction unit 314, and the first data compensation unit 315.

The first afterimage detection unit 311 may receive an input image and detect the first afterimage area AIA1 including the afterimage AI in the first display area DA1 (operation S110). The first afterimage detection unit 311 may provide the first communication unit 312 with the type of the afterimage AI in the first afterimage area AIA1, the existence probability of the afterimage AI, and the coordinates of the first afterimage area AIA1.

The first communication unit 312 may perform wired or wireless communication with the second communication unit 322. The first communication unit 312 may transmit the afterimage detection result of the first afterimage area AIA1 to the second communication unit 322, and may receive the afterimage detection result of the second afterimage area AIA2 from the second communication unit 322 (operation S120).

The first comparison unit 313 may compare the afterimage detection results of the first and second display areas DA1 and DA2 (operation S130). The first comparison unit 313 may compare the types of the afterimages AI in the first and second afterimage areas AIA1 and AIA2, the existence probabilities of the afterimages AI, and the coordinates of the first and second afterimage areas AIA1 and AIA2.

The first coordinate correction unit 314 may correct the coordinates of the first afterimage area AIA1 based on the afterimage coincidence signal received from the first comparison unit 313 (operation S140). The first coordinate correction unit 314 may provide the coordinates of a corrected afterimage area CIA to the first data compensation unit 315.

The first data compensation unit 315 may generate a compensation data voltage by adjusting the saturation or luminance of the corrected afterimage area CIA (operation S150). Accordingly, the first data driver 310 may prevent or reduce the occurrence of the afterimage in the first display area DA1, reduce color shift, and improve the display quality.

Figure 11:
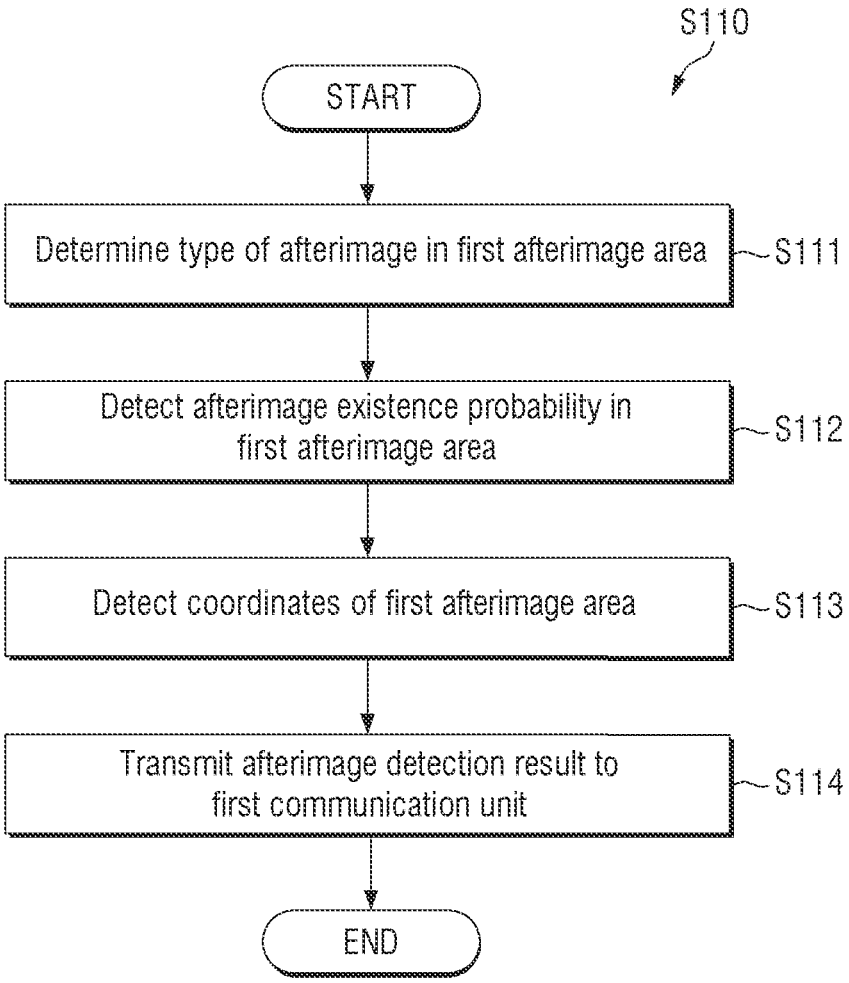
FIG. 11 is a flowchart illustrating an afterimage detection process of a first afterimage detection unit in a display device according to some embodiments.

FIG. 11 is a flowchart illustrating an afterimage detection process of a first afterimage detection unit in a display device according to some embodiments. Embodiments according to the present disclosure are not limited to the number or order of operations illustrated in FIG. 11, however. For example, according to some embodiments, there may be additional operations, or fewer operations, or the order of the operations may vary from what is illustrated in FIG. 11, without departing from the spirit and scope of embodiments according to the present disclosure. The afterimage detection process of FIG. 11 may correspond to operation S110 of FIG. 10.

Referring to FIG. 11, the first afterimage detection unit 311 may receive an input image and detect the first afterimage area AIA1 including the afterimage AI in the first display area DA1.

The first afterimage detection unit 311 may include a type determination module 3111, an afterimage detection module 3112, and a coordinate detection module 3113.

The type determination module 3111 may determine the type of the afterimage AI in the first afterimage area AIA1 (operation S111). For example, the type determination module 3111 may determine whether the afterimage AI in the first afterimage area AIA1 corresponds to a caption, a logo, or a banner.

The afterimage detection module 3112 may detect the existence probability of the afterimage AI in the first afterimage area AIA1 (operation S112). For example, the existence probability of the afterimage AI may correspond to a pixel size of an area in which the afterimage AI is displayed from a pixel size of the first afterimage area AIA1.

The coordinate detection module 3113 may detect the coordinates of the first afterimage area AIA1 (operation S113). The coordinate detection module 3113 may detect the coordinates of the first afterimage area AIA1 in the first direction (X-axis direction) and in the second direction (Y-axis direction).

The first afterimage detection unit 311 may transmit the afterimage detection result to the first communication unit 312 (operation S114). The first afterimage detection unit 311 may provide the first communication unit 312 with the type of the afterimage AI of the first afterimage area AIA1 determined by the type determination module 3111, the existence probability of the afterimage AI detected by the afterimage detection module 3112, and the coordinates of the first afterimage area AIA1 detected by the coordinate detection module 3113.

Figure 12:
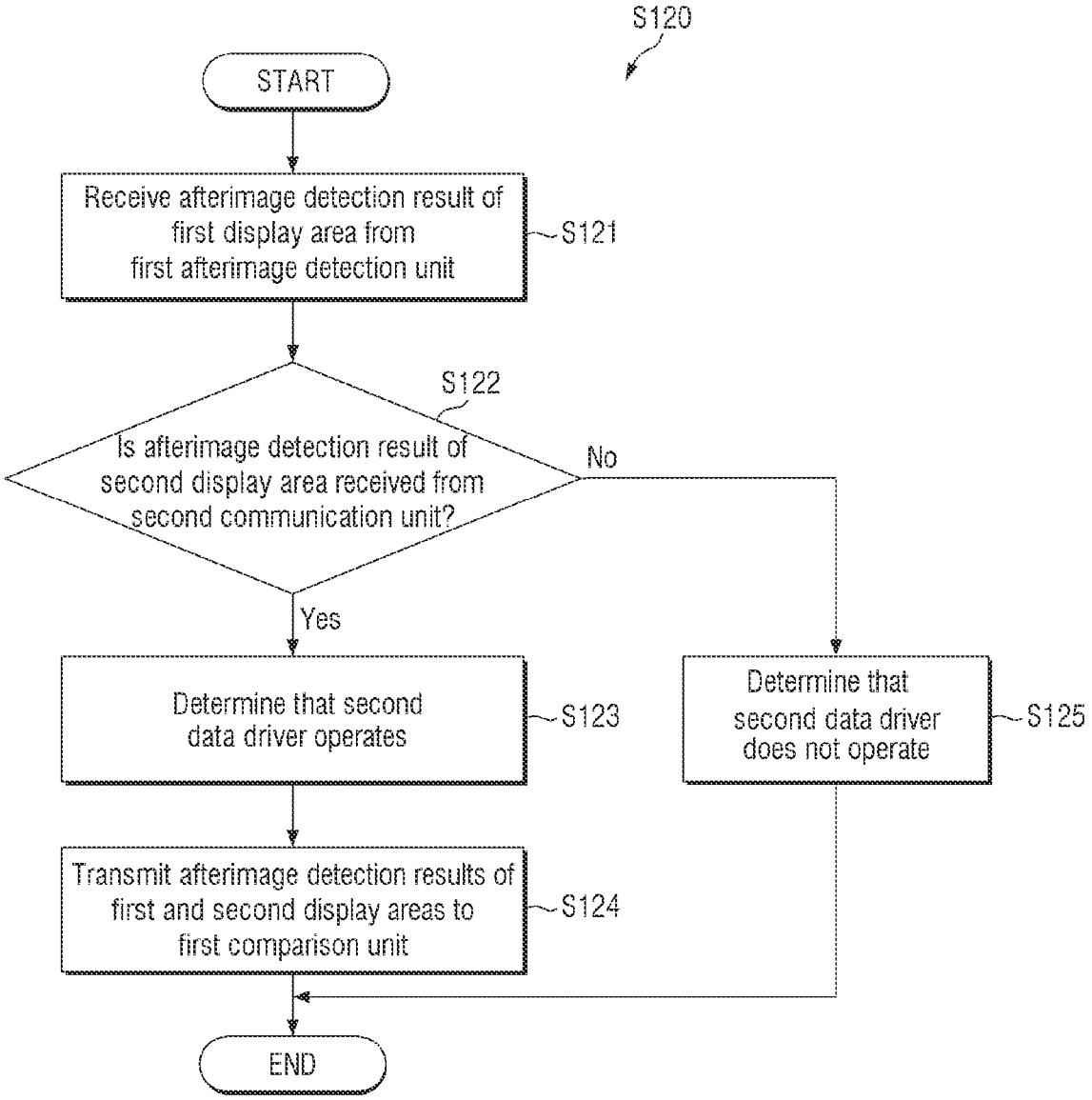
FIG. 12 is a flowchart illustrating a communication process of a first communication unit in a display device according to some embodiments.

FIG. 12 is a flowchart illustrating a communication process of a first communication unit in a display device according to some embodiments. Embodiments according to the present disclosure are not limited to the number or order of operations illustrated in FIG. 12, however. For example, according to some embodiments, there may be additional operations, or fewer operations, or the order of the operations may vary from what is illustrated in FIG. 12, without departing from the spirit and scope of embodiments according to the present disclosure. The communication process of FIG. 12 corresponds to operation S120 of FIG. 10.

Referring to FIG. 12, the first communication unit 312 may receive the afterimage detection result of the first display area DA1 from the first afterimage detection unit 311 (operation S121).

The first communication unit 312 may perform wired or wireless communication with the second communication unit 322. The first communication unit 312 may transmit the afterimage detection result of the first afterimage area AIA1 to the second communication unit 322, and may receive the afterimage detection result of the second afterimage area AIA2 from the second communication unit 322. The first communication unit 312 may determine whether the second data driver 320 including the second communication unit 322 operates or not based on whether the afterimage detection result is received (operation S122).

When the first communication unit 312 receives the afterimage detection result of the second afterimage area AIA2 from the second communication unit 322, the first communication unit 312 may determine that the second data driver 320 operates (operation S123). In this case, the first communication unit 312 may transmit the afterimage detection results of the first and second display areas DA1 and DA2 to the first comparison unit 313 (operation S124).

When the first communication unit 312 does not receive the afterimage detection result of the second afterimage area AIA2 from the second communication unit 322, the first communication unit 312 may determine that the second data driver 320 does not operate (operation S125). In this case, the first communication unit 312 may transmit the afterimage detection result of only the first display area DA1 to the first comparison unit 313, regardless of whether the afterimage detection results of the third and fourth display areas DA3 and DA4 have been received or not.

Figure 13:
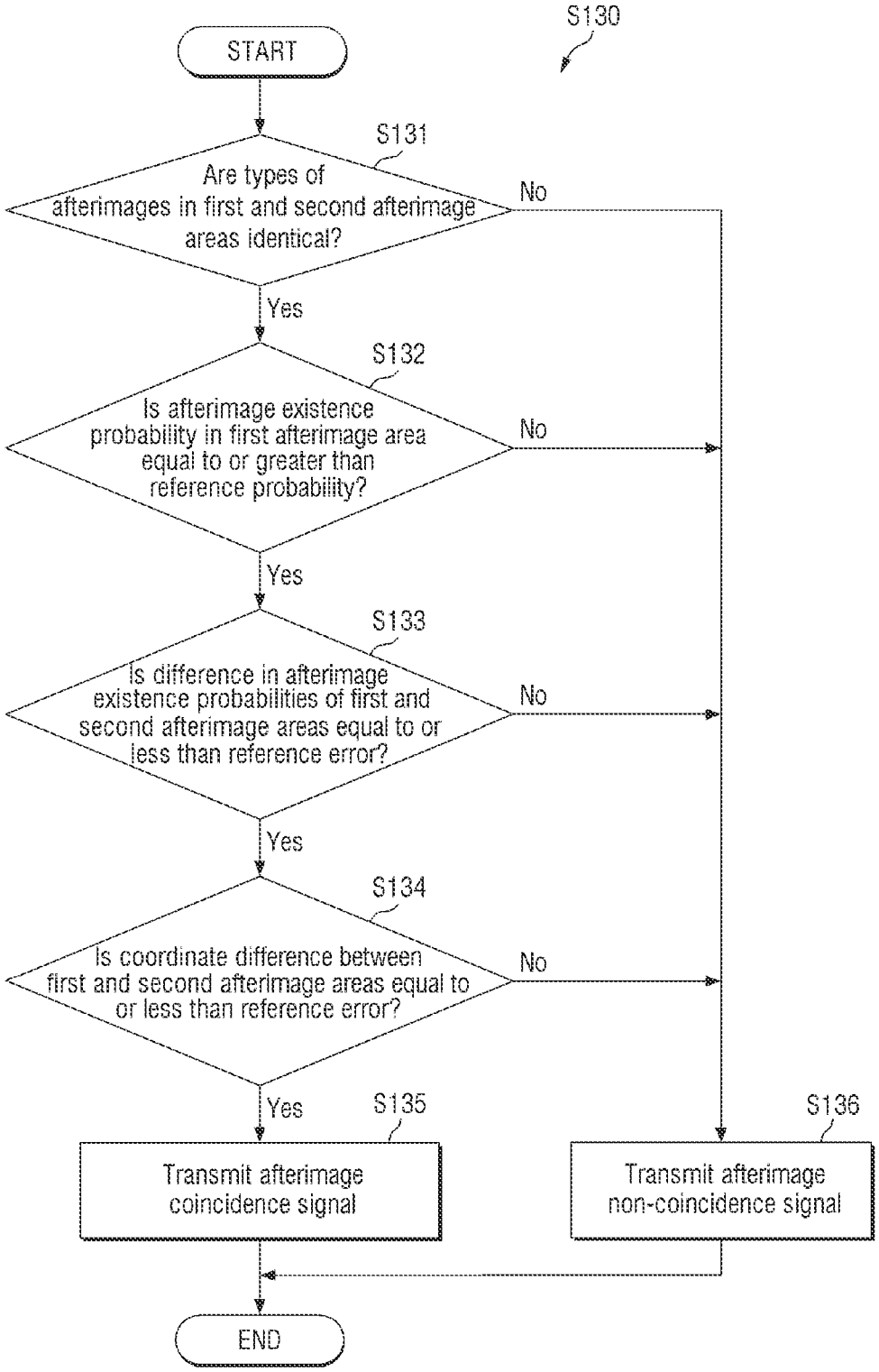
FIG. 13 is a flowchart illustrating an afterimage comparison process of a first comparison unit in a display device according to some embodiments.

FIG. 13 is a flowchart illustrating an afterimage comparison process of a first comparison unit in a display device according to some embodiments. Embodiments according to the present disclosure are not limited to the number or order of operations illustrated in FIG. 13, however. For example, according to some embodiments, there may be additional operations, or fewer operations, or the order of the operations may vary from what is illustrated in FIG. 13, without departing from the spirit and scope of embodiments according to the present disclosure. The afterimage comparison process of FIG. 13 corresponds to operation S130 of FIG. 10.

Referring to FIG. 13, the first comparison unit 313 may receive the afterimage detection results of the first and second display areas DA1 and DA2.

The first comparison unit 313 may include the type comparison module 3131, the probability comparison module 3132, and the coordinate comparison module 3133.

The type comparison module 3131 may compare the types of the afterimages AI in the first and second afterimage areas AIA1 and AIA2. The type comparison module 3131 may determine whether the types of the afterimages AI in the first and second afterimage areas AIA1 and AIA2 are identical (operation S131). When the types of the afterimages AI in the first to fourth afterimage areas AIA1, AIA2, AIA3, and AIA4 are the same, the type comparison module 3131 may provide a type coincidence signal to the probability comparison module 3132.

The probability comparison module 3132 may compare the afterimage existence probabilities of the first and second afterimage areas AIA1 and AIA2. The probability comparison module 3132 may compare the afterimage existence probability of each of the first and second afterimage areas AIA1 and AIA2 with a preset reference probability (operation S132). For example, the probability comparison module 3132 may determine whether the afterimage existence probability of each of the first and second afterimage areas AIA1 and AIA2 is 0.75 or more, but the reference probability is not limited thereto.

When the afterimage existence probability of each of the first and second afterimage areas AIA1 and AIA2 is greater than or equal to the reference probability, the probability comparison module 3132 may compare a difference in the afterimage existence probabilities of the first and second afterimage areas AIA1 and AIA2 with a preset reference error (operation S133). For example, the probability comparison module 3132 may determine whether the difference in the afterimage existence probabilities of the first and second afterimage areas AIA1 and AIA2 is 0.05 or less, but the reference error is not limited thereto.

The coordinate comparison module 3133 may compare the coordinates of the first and second afterimage areas AIA1 and AIA2 (operation S134). The coordinate comparison module 3133 may obtain a coordinate difference in the first direction (X-axis direction) between the first and second afterimage areas AIA1 and AIA2. The coordinate comparison module 3133 may obtain a coordinate difference in the second direction (Y-axis direction) between the upper ends of the first and second afterimage areas AIA1 and AIA2, and may obtain a coordinate difference in the second direction (Y-axis direction) between the lower ends of the first and second afterimage areas AIA1 and AIA2.

For example, when a coordinate difference in the first direction (X-axis direction) between the first and second afterimage areas AIA1 and AIA2, a coordinate difference in the second direction (Y-axis direction) between the upper ends of the first and second afterimage areas AIA1 and AIA2, and a coordinate difference in the second direction (Y-axis direction) between the lower ends of the first and second afterimage areas AIA1 and AIA2 are less than or equal to the reference error, the coordinate comparison module 3133 may determine that the coordinate difference between the first and second afterimage areas AIA1 and AIA2 is less than or equal to the reference error and may transmit an afterimage coincidence signal for the first and second afterimage areas AIA1 and AIA2 to the first coordinate correction unit 314 (operation S135).

For another example, when the types of the afterimages AI in the first and second afterimage areas AIA1 and AIA2 are different, the type comparison module 3131 may transmit an afterimage non-coincidence signal to the first coordinate correction unit 314. When the afterimage existence probability of at least one of the first or second afterimage areas AIA1 and AIA2 is less than the reference probability, the probability comparison module 3132 may transmit the afterimage non-coincidence signal for the first and second afterimage areas AIA1 and AIA2 to the first coordinate correction unit 314. When the coordinate difference between the first and second afterimage areas AIA1 and AIA2 exceeds a reference error, the coordinate comparison module 3133 may transmit the afterimage non-coincidence signal for the first and second afterimage areas AIA1 and AIA2 to the first coordinate correction unit 314.

Figure 14:
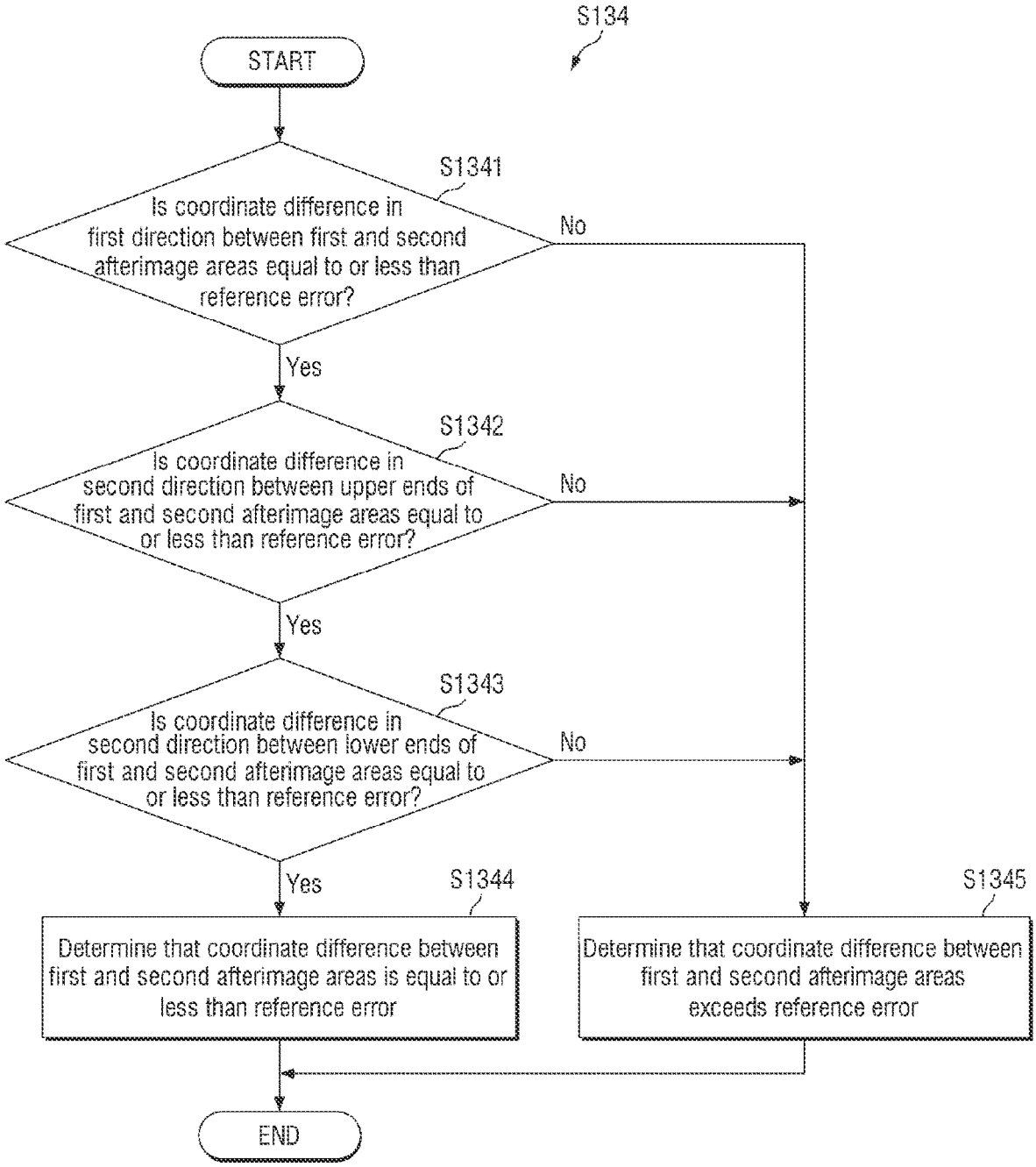
FIG. 14 is a flowchart illustrating a coordinate comparison process of a coordinate comparison module in a display device according to some embodiments.

FIG. 14 is a flowchart illustrating a coordinate comparison process of a coordinate comparison module in a display device according to some embodiments. Embodiments according to the present disclosure are not limited to the number or order of operations illustrated in FIG. 14, however. For example, according to some embodiments, there may be additional operations, or fewer operations, or the order of the operations may vary from what is illustrated in FIG. 14, without departing from the spirit and scope of embodiments according to the present disclosure. The coordinate comparison process of FIG. 14 corresponds to operation S134 of FIG. 13.

Referring to FIG. 14, the coordinate comparison module 3133 may compare a coordinate difference in the first direction (X-axis direction) between the first and second afterimage areas AIA1 and AIA2 with a preset reference error (operation S1341). Here, the reference error of the coordinates may correspond to 3% of the resolution, but embodiments according to the present disclosure are not limited thereto.

The coordinate comparison module 3133 may compare a coordinate difference in the second direction (Y-axis direction) between the upper ends of the first and second afterimage areas AIA1 and AIA2 with the reference error (operation S1342).

The coordinate comparison module 3133 may compare a coordinate difference in the second direction (Y-axis direction) between the lower ends of the first and second afterimage areas AIA1 and AIA2 with the reference error (operation S1343).

When a coordinate difference in the first direction (X-axis direction) between the first and second afterimage areas AIA1 and AIA2, a coordinate difference in the second direction (Y-axis direction) between the upper ends of the first and second afterimage areas AIA1 and AIA2, and a coordinate difference in the second direction (Y-axis direction) between the lower ends of the first and second afterimage areas AIA1 and AIA2 are less than or equal to the reference error, the coordinate comparison module 3133 may determine that the coordinate difference between the first and second afterimage areas AIA1 and AIA2 is less than or equal to the reference error (operation S1344).

When a coordinate difference in the first direction (X-axis direction) between the first and second afterimage areas AIA1 and AIA2 exceeds the reference error, the coordinate comparison module 3133 may determine that the coordinate difference between the first and second afterimage areas AIA1 and AIA2 exceeds the reference error (operation S1345). When a coordinate difference in the second direction (Y-axis direction) between the upper ends of the first and second afterimage areas AIA1 and AIA2 exceeds the reference error, the coordinate comparison module 3133 may determine that the coordinate difference between the first and second afterimage areas AIA1 and AIA2 exceeds the reference error. When a coordinate difference in the second direction (Y-axis direction) between the lower ends of the first and second afterimage areas AIA1 and AIA2 exceeds the reference error, the coordinate comparison module 3133 may determine that the coordinate difference between the first and second afterimage areas AIA1 and AIA2 exceeds the reference error.

Figure 15:
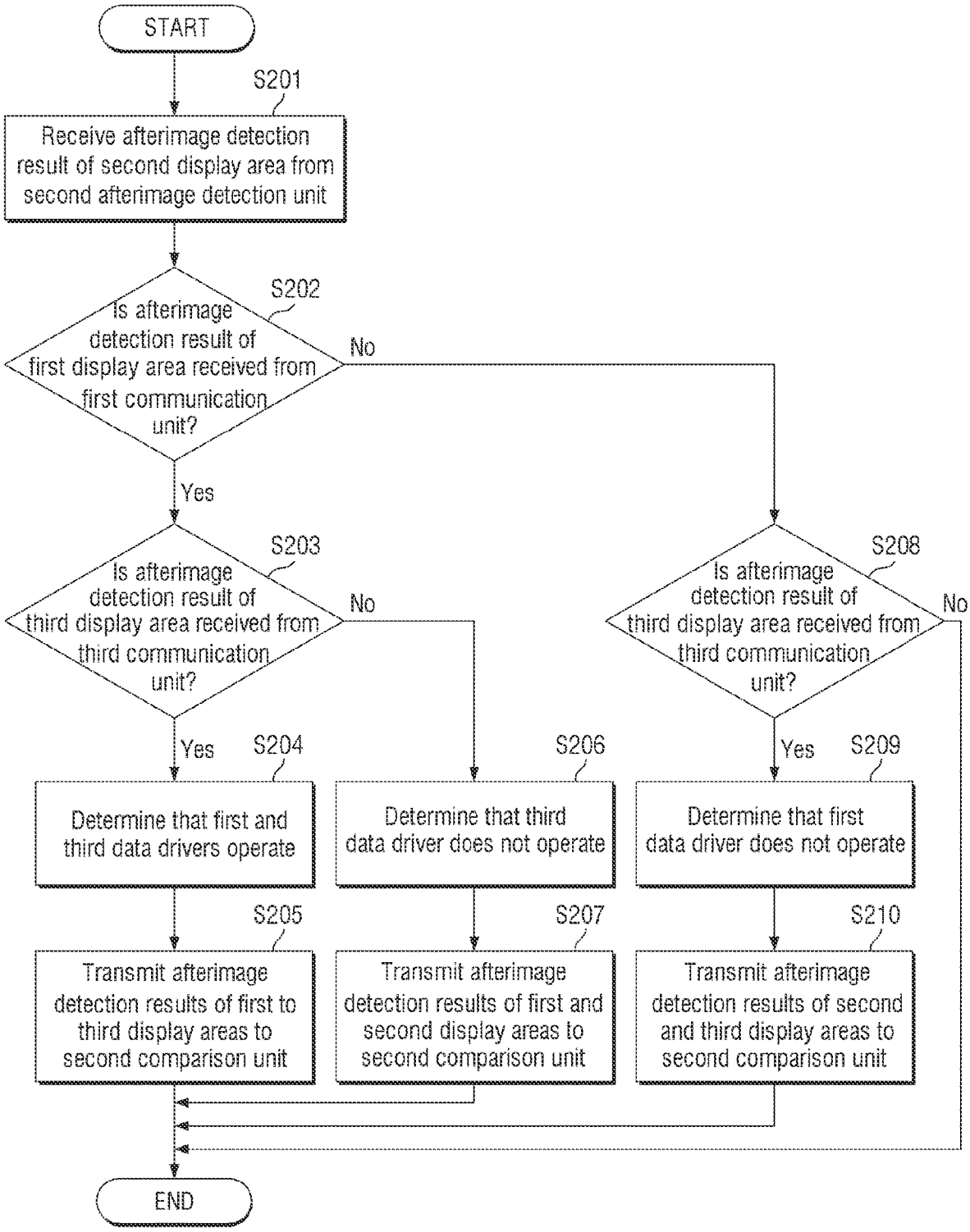
FIG. 15 is a flowchart illustrating a communication process of a second communication unit in a display device according to some embodiments.

FIG. 15 is a flowchart illustrating a communication process of a second communication unit in a display device according to some embodiments. Embodiments according to the present disclosure are not limited to the number or order of operations illustrated in FIG. 15, however. For example, according to some embodiments, there may be additional operations, or fewer operations, or the order of the operations may vary from what is illustrated in FIG. 15, without departing from the spirit and scope of embodiments according to the present disclosure.

Referring to FIG. 15, the second communication unit 322 may receive an afterimage detection result of the second display area DA2 from the second afterimage detection unit 321 (operation S201).

The second communication unit 322 may perform wired or wireless communication with the first communication unit 312. The second communication unit 322 may transmit the afterimage detection result of the second afterimage area AIA2 to the first communication unit 312, and may receive the afterimage detection result of the first afterimage area AIA1 from the first communication unit 312. The second communication unit 322 may determine whether the first data driver 310 including the first communication unit 312 operates or not based on whether the afterimage detection result is received (operation S202).

The second communication unit 322 may perform wired or wireless communication with the third communication unit 332. The second communication unit 322 may transmit the afterimage detection result of the second afterimage area AIA2 to the third communication unit 332, and may receive the afterimage detection result of the third afterimage area AIA3 from the third communication unit 332. The second communication unit 322 may determine whether the third data driver 330 including the third communication unit 332 operates or not based on whether the afterimage detection result is received (operations S203 and S208).

When the second communication unit 322 receives the afterimage detection results of the first and third afterimage areas AIA1 and AIA3 from the first and third communication units 312 and 332, respectively, the second communication unit 322 may determine that the first and third data driving units 310 and 330 operate (operation S204). In this case, the second communication unit 322 may transmit the afterimage detection results of the first to third display areas DA1, DA2, and DA3 to the second comparison unit 323 (operation S205).

When the second communication unit 322 receives the afterimage detection result of the first afterimage area AIA1 from the first communication unit 312 and does not receive the afterimage detection result of the third afterimage area AIA3 from the third communication unit 332, the second communication unit 322 may determine that the third data driver 330 does not operate (operation S206). In this case, the second communication unit 322 may transmit the afterimage detection results of the first and second display areas DA1 and DA2 to the second comparison unit 323 (operation S207).

When the second communication unit 322 does not receive the afterimage detection result of the first afterimage area AIA1 from the first communication unit 312, and receives the afterimage detection result of the third afterimage area AIA3 from the third communication unit 332, the second communication unit 322 may determine that the first data driver 310 does not operate (operation S209). In this case, the second communication unit 322 may transmit the afterimage detection results of the second and third display areas DA2 and DA3 to the second comparison unit 323 (operation S210).

When the second communication unit 322 does not receive the afterimage detection results of the first and third afterimage areas AIA1 and AIA3 from the first and third communication units 312 and 332, respectively, the communication unit 322 may determine that the first and third data drivers 310 and 330 do not operate. In this case, the second communication unit 322 may transmit the afterimage detection result of only the first display area DA to the second comparison unit 323.

Figure 16:
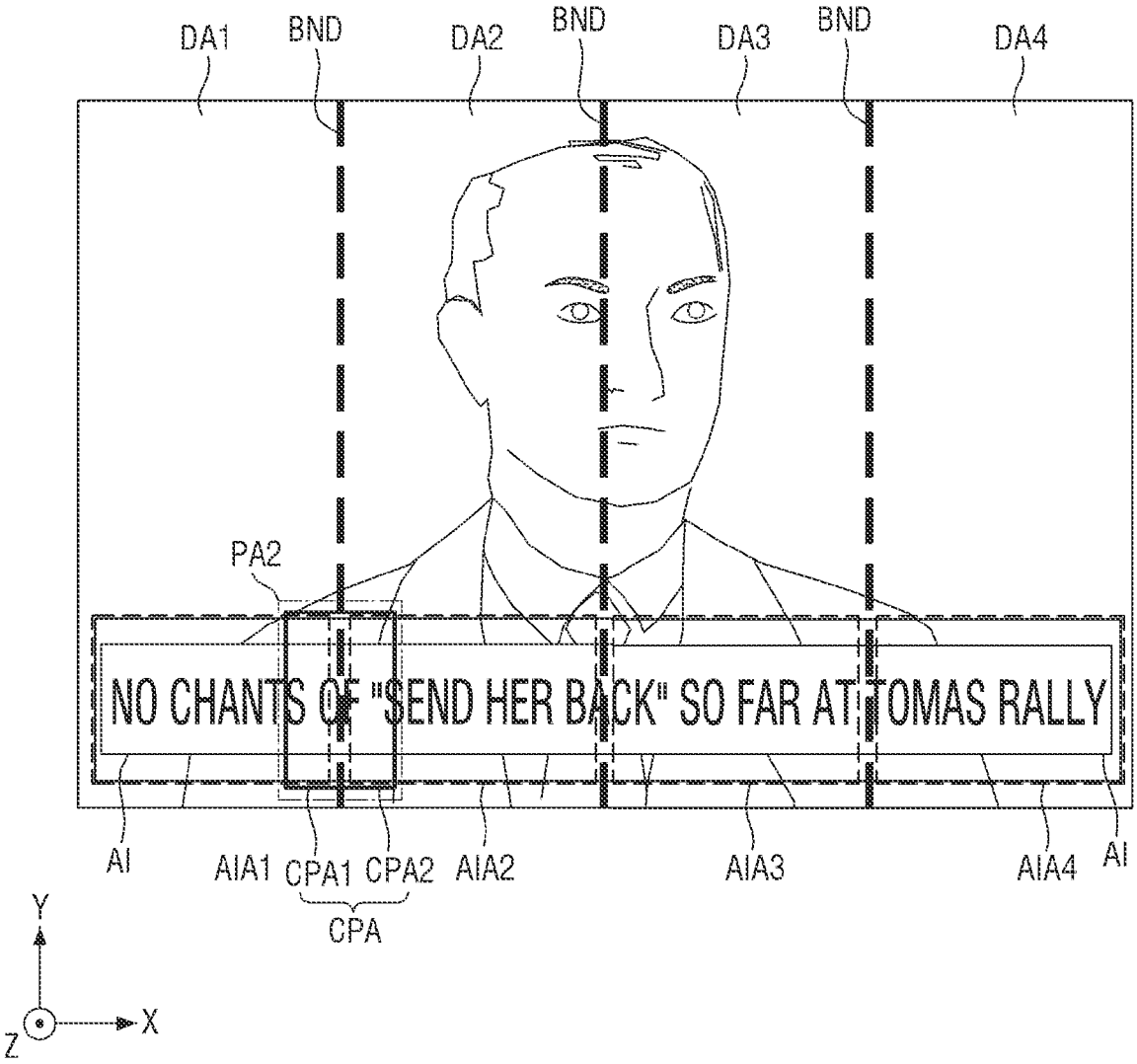
FIG. 16 is a diagram illustrating first to fourth display areas in a display device according to some embodiments.
Figure 17:
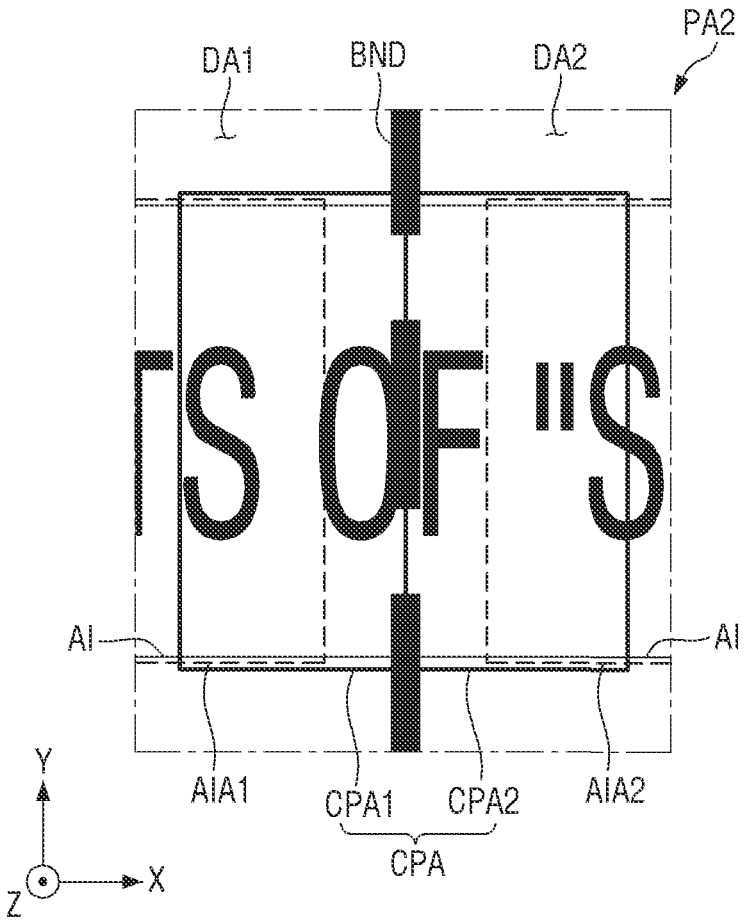
FIG. 17 is an enlarged view of region PA2 of FIG. 16.

FIG. 16 is a diagram illustrating first to fourth display areas in a display device according to some embodiments. FIG. 17 is an enlarged view of region PA2 of FIG. 16. Hereinafter, the same configuration as the above-described configuration will be briefly described or omitted.

Referring to FIGS. 16 and 17, the data driver 300 may include the first to fourth data drivers 310, 320, 330, and 340.

The first data driver 310 may include the first afterimage detection unit 311, the first communication unit 312, the first comparison unit 313, the first coordinate correction unit 314, and the first data compensation unit 315.

The first afterimage detection unit 311 may receive an input image and detect the first afterimage area AIA1 including the afterimage AI in the first display area DA1. For example, the first afterimage detection unit 311 may detect a segmentation-type afterimage pixel. The first afterimage detection unit 311 may detect the number of afterimage pixels and the coordinates of the afterimage pixels in the first afterimage area AIA1. The first afterimage detection unit 311 may provide the number of afterimage pixels and the coordinates of the afterimage pixels in the first afterimage area AIA1 to the first communication unit 312.

The first communication unit 312 may perform wired or wireless communication with the second communication unit 322. The first communication unit 312 may transmit the afterimage detection result of the first afterimage area AIA1 to the second communication unit 322, and may receive the afterimage detection result of the second afterimage area AIA2 from the second communication unit 322. The first communication unit 312 may determine whether the second data driver 320 including the second communication unit 322 operates or not based on whether the afterimage detection result is received. The first communication unit 312 may provide an afterimage detection result of each of the first and second afterimage areas AIA1 and AIA2 to the first comparison unit 313.

The first comparison unit 313 may compare the number of afterimage pixels in a comparison target area CPA with a preset reference number. The comparison target area CPA may include a first comparison target area CPA1 of the first display area DA1 in contact with one side of the border line BND between the first and second display areas DA1, and a second comparison target area CPA2 of the second display area DA2 in contact with the other side of the boundary line BND. Accordingly, the first comparison unit 313 may compare the sum of the number of afterimage pixels in the first and second comparison target areas CPA1 and CPA2 with the preset reference number.

For example, the first comparison unit 313 may determine whether the number of afterimage pixels in the comparison target area CPA is 80% or more of the total number of pixels in the comparison target area CPA, but the reference number is not limited thereto. When the number of afterimage pixels in the comparison target area CPA is 80% or more of the total number of pixels in the comparison target area CPA, the first comparison unit 313 may provide an afterimage coincidence signal to the first coordinate correction unit 314. When the number of afterimage pixels in the comparison target area CPA is less than 80% of the total number of pixels in the comparison target area CPA, the first comparison unit 313 may provide an afterimage non-coincidence signal to the first coordinate correction unit 314.

The first and second comparison target areas CPA1 and CPA2 may be symmetrical with respect to the boundary line BND. A length of each of the first and second comparison target areas CPA1 and CPA2 in the first direction (X-axis direction) may have a size (e.g., a set or predetermined size) with respect to the boundary line BND. For example, the length of each of the first and second comparison target areas CPA1 and CPA2 in the first direction (X-axis direction) may be 1% of the resolution, but is not limited thereto. For another example, the length of each of the first and second comparison target areas CPA1 and CPA2 in the first direction (X-axis direction) may be determined based on the length between the first afterimage area AIA1 and the boundary line BND, and the length between the second afterimage area AIA2 and the boundary line BND. The length of each of the first and second comparison target areas CPA1 and CPA2 in the first direction (X-axis direction) may be greater than the length between the first afterimage area AIA1 and the boundary line BND, and the length between the second afterimage area AIA2 and the boundary line BND.

The length of each of the first and second comparison target areas CPA1 and CPA2 in the second direction (Y-axis direction) may be determined based on the upper and lower ends of the first comparison target area CPA1, and the upper and lower ends of the second comparison target area CPA2. For example, the upper coordinates of each of the first and second comparison target areas CPA1 and CPA2 may be identical with a larger one of the upper coordinates of the first comparison target area CPA1 and the upper coordinates of the second comparison target area CPA2. The lower coordinates of each of the first and second comparison target areas CPA1 and CPA2 may be identical with a smaller one of the lower coordinates of the first comparison target area CPA1 and the lower coordinates of the second comparison target area CPA2.

The first coordinate correction unit 314 may correct the coordinates of the first afterimage area AIA1 based on the afterimage coincidence signal received from the first comparison unit 313. The first coordinate correction unit 314 may correct the first afterimage area AIA1 so that the first afterimage area AIA1 includes the first comparison target area CPA1. For example, the first coordinate correction unit 314 may extend the coordinates in the first direction (X-axis direction) of the first afterimage area AIA1 to the boundary line BND. The first coordinate correction unit 314 may extend the coordinates in the second direction (Y-axis direction) of the first afterimage area AIA1 to the coordinates in the second direction (Y-axis direction) of the comparison target area CPA. The first coordinate correction unit 314 may provide the coordinates of a corrected afterimage area CIA to the first data compensation unit 315.

The first data compensation unit 315 may generate a compensation data voltage by adjusting the saturation or luminance of the corrected afterimage area CIA. Accordingly, even when the first afterimage area AIA1 does not include the afterimage AI adjacent to the boundary line BND between the first and second display areas DA1 and DA2, the first data driver 310 may correct the first afterimage area AIA1 up to the boundary line BND. Even when the display area DA is dividedly driven, the first data driver 310 may precisely detect an afterimage area of an adjacent display area to generate a compensation data voltage corrected for saturation or luminance. The first data driver 310 may prevent or reduce the occurrence of the afterimage in the first display area DA1, reduce color shift, and improve the display quality.

Figure 18:
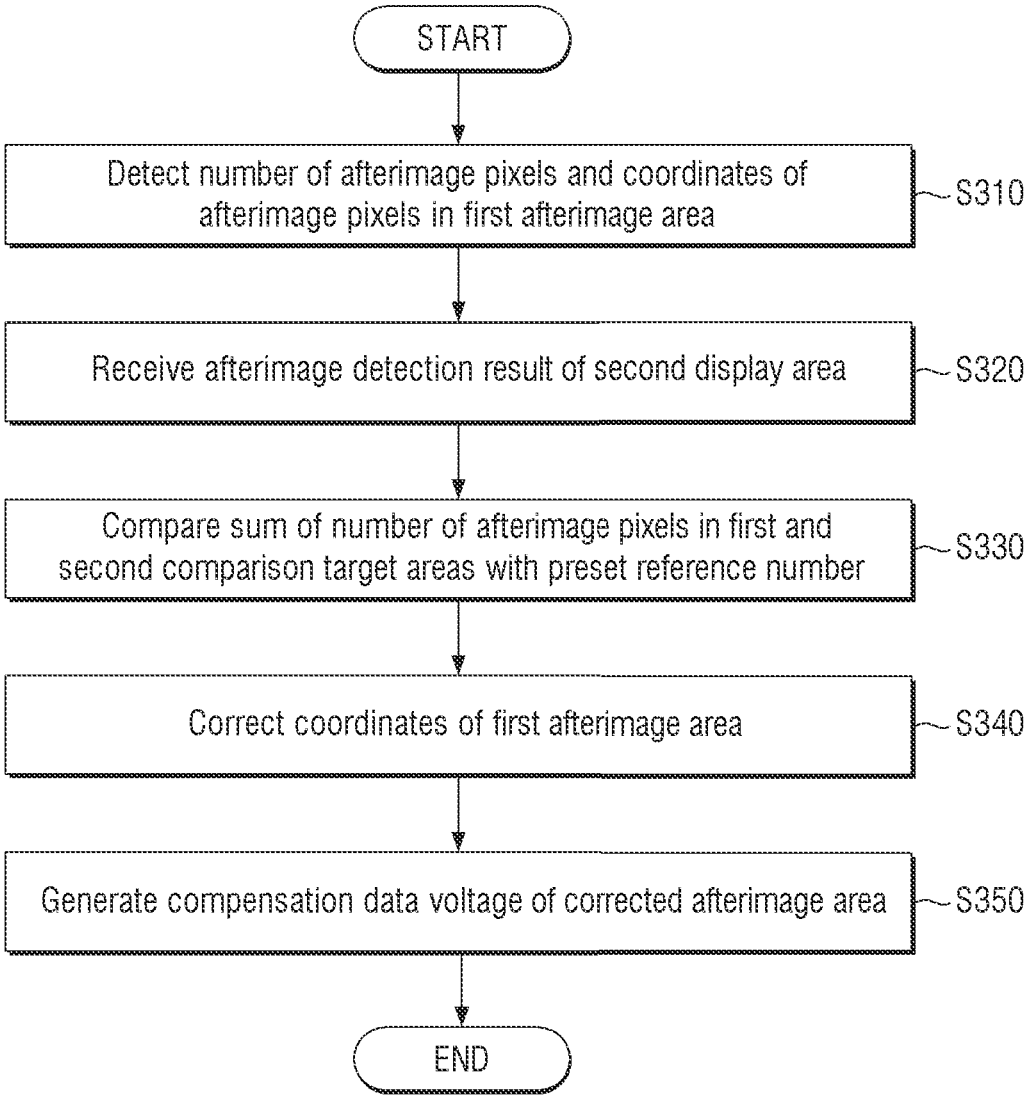
FIG. 18 is a flowchart illustrating an afterimage processing process of a first data driver in the display device of FIG. 16.

FIG. 18 is a flowchart illustrating an afterimage processing process of a first data driver in the display device of FIG. 16. Embodiments according to the present disclosure are not limited to the number or order of operations illustrated in FIG. 18, however. For example, according to some embodiments, there may be additional operations, or fewer operations, or the order of the operations may vary from what is illustrated in FIG. 18, without departing from the spirit and scope of embodiments according to the present disclosure. The afterimage processing process of FIG. 18 corresponds to a case where the first data driver 310 receives the afterimage detection result from the second data driver 320 among the second to fourth data drivers 320, 330, and 340.

Referring to FIG. 18, the first data driver 310 may include the first afterimage detection unit 311, the first communication unit 312, the first comparison unit 313, the first coordinate correction unit 314, and the first data compensation unit 315.

The first afterimage detection unit 311 may receive an input image and detect the first afterimage area AIA1 including the afterimage AI in the first display area DA1. For example, the first afterimage detection unit 311 may detect a segmentation-type afterimage pixel. The first afterimage detection unit 311 may detect the number of afterimage pixels and the coordinates of the afterimage pixels in the first afterimage area AIA1 (operation S310). The first afterimage detection unit 311 may provide the number of afterimage pixels and the coordinates of the afterimage pixels in the first afterimage area AIA1 to the first communication unit 312.

The first communication unit 312 may perform wired or wireless communication with the second communication unit 322. The first communication unit 312 may transmit the afterimage detection result of the first afterimage area AIA1 to the second communication unit 322, and may receive the afterimage detection result of the second afterimage area AIA2 from the second communication unit 322 (operation S320).

The first comparison unit 313 may compare the number of afterimage pixels in a comparison target area CPA with a preset reference number. The first comparison unit 313 may compare the sum of the number of afterimage pixels in the first and second comparison target areas CPA1 and CPA2 with the preset reference number (operation S330).

The first coordinate correction unit 314 may correct the coordinates of the first afterimage area AIA1 based on the afterimage coincidence signal received from the first comparison unit 313 (operation S340). The first coordinate correction unit 314 may correct the first afterimage area AIA1 so that the first afterimage area AIA1 includes the first comparison target area CPA1. The first coordinate correction unit 314 may provide the coordinates of a corrected afterimage area CIA to the first data compensation unit 315.

The first data compensation unit 315 may generate a compensation data voltage by adjusting the saturation or luminance of the corrected afterimage area CIA (operation S350). Accordingly, the first data driver 310 may prevent or reduce the occurrence of the afterimage in the first display area DA1, reduce color shift, and improve the display quality.

Figure 19:
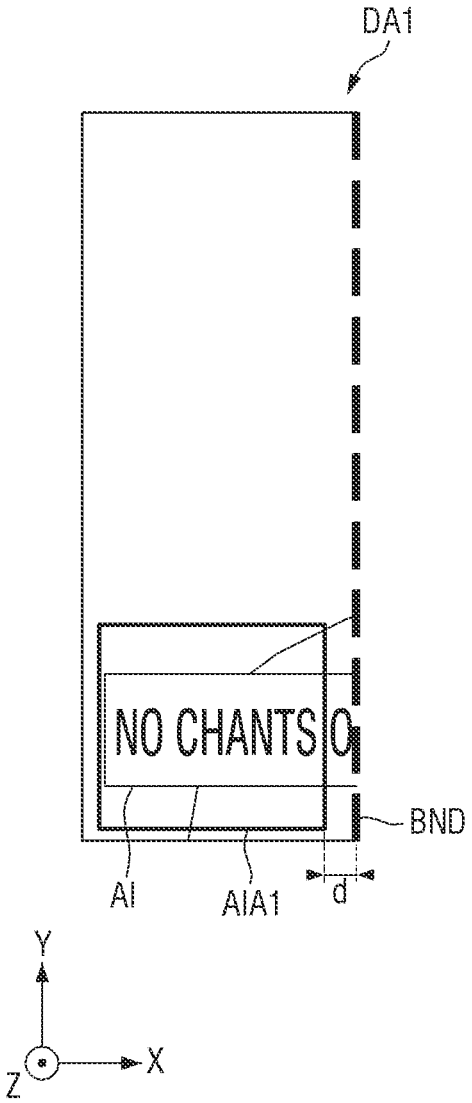
FIG. 19 is a diagram illustrating a first display area in a display device according to some embodiments.

FIG. 19 is a diagram illustrating a first display area in a display device according to some embodiments.

Referring to FIG. 19, the data driver 300 may include the first to fourth data drivers 310, 320, 330, and 340.

The first data driver 310 may include the first afterimage detection unit 311, the first communication unit 312, the first comparison unit 313, the first coordinate correction unit 314, and the first data compensation unit 315.

The first afterimage detection unit 311 may receive an input image and detect the first afterimage area AIA1 including the afterimage AI in the first display area DA1.

The first communication unit 312 may not receive the afterimage detection results of the second to fourth afterimage areas AIA2, AIA3, and AIA4 from the second to fourth communication units 322, 332, and 342. For example, even when the second to fourth data drivers 320, 330, and 340 are driven, the first communication unit 312 may not selectively communicate with the second to fourth communication units 322, 332, and 342. For another example, when the second data driver 320 is not driven, the first communication unit 312 may not communicate with the second to fourth communication units 322, 332, and 342. The first communication unit 312 may provide the afterimage detection result of the first afterimage area AIA1 to the first comparison unit 313.

The first comparison unit 313 may compare a distance between the first afterimage area AIA1 and the boundary line BND between the first and second display areas DA1 and DA2 with a preset reference distance. For example, when the distance between the boundary line BND and the first afterimage area AIA1 is smaller than the reference distance, the first comparison unit 313 may transmit an afterimage correction signal to the first coordinate correction unit 314. Here, the reference distance may be 1% of the resolution, but is not limited thereto. When the distance between the boundary line BND and the first afterimage area AIA1 exceeds the reference distance, the first comparison unit 313 may transmit an afterimage non-correction signal to the first coordinate correction unit 314.

When receiving the afterimage correction signal, the first coordinate correction unit 314 may extend the coordinates in the first direction (X-axis direction) of the first afterimage area AIA1 to the boundary line BND. The first coordinate correction unit 314 may provide the coordinates of a corrected afterimage area CIA to the first data compensation unit 315.

The first data compensation unit 315 may generate a compensation data voltage by adjusting the saturation or luminance of the corrected afterimage area CIA. Accordingly, even when the first afterimage area AIA1 does not include the afterimage AI adjacent to the boundary line BND between the first and second display areas DA1 and DA2, the first data driver 310 may correct the first afterimage area AIA1 up to the boundary line BND. Even when the display area DA is dividedly driven, the first data driver 310 may precisely detect an afterimage area of an adjacent display area to generate a compensation data voltage corrected for saturation or luminance. The first data driver 310 may prevent or reduce the occurrence of the afterimage in the first display area DA1, reduce color shift, and improve the display quality.

Figure 20:
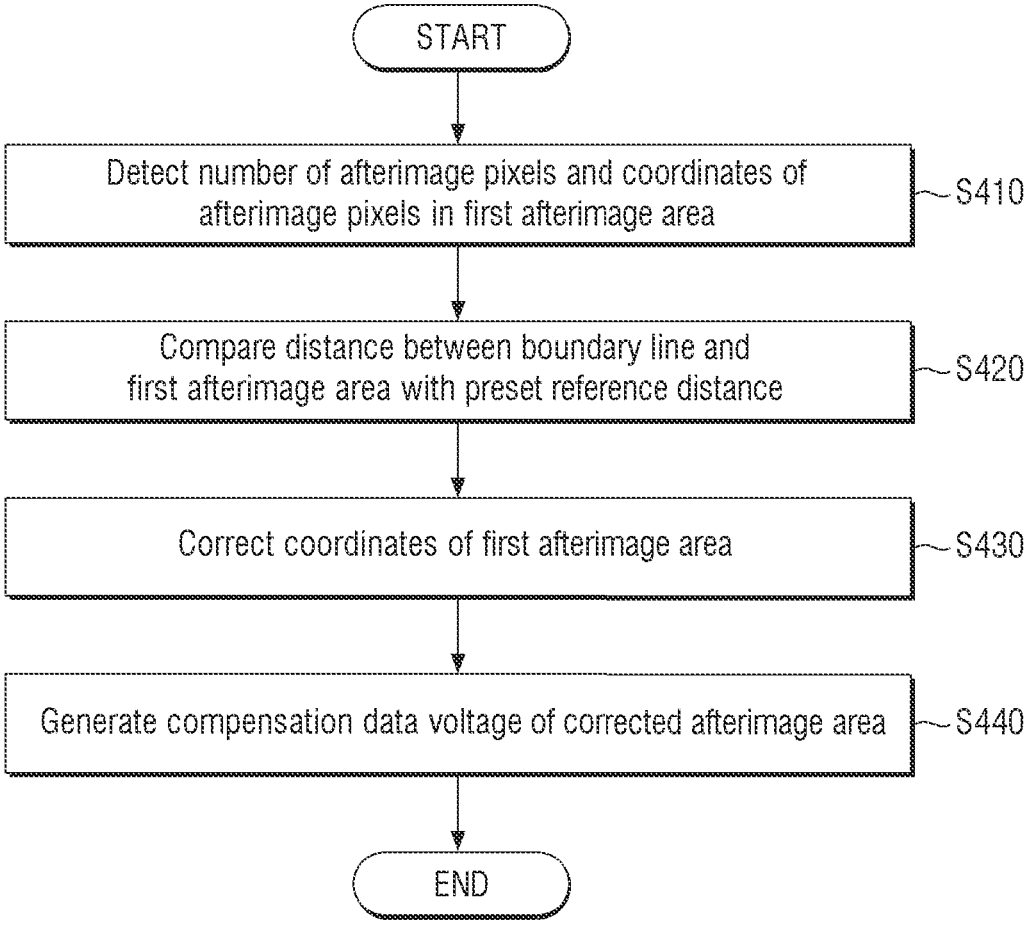
FIG. 20 is a flowchart illustrating an afterimage processing process of a first data driver in the display device of FIG. 19.

FIG. 20 is a flowchart illustrating an afterimage processing process of a first data driver in the display device of FIG. 19. Embodiments according to the present disclosure are not limited to the number or order of operations illustrated in FIG. 20, however. For example, according to some embodiments, there may be additional operations, or fewer operations, or the order of the operations may vary from what is illustrated in FIG. 20, without departing from the spirit and scope of embodiments according to the present disclosure. The afterimage processing process of FIG. 20 corresponds to a case in which the first data driver 310 does not receive the afterimage detection results from the second to fourth data drivers 320, 330, and 340.

Referring to FIG. 20, the first data driver 310 may include the first afterimage detection unit 311, the first communication unit 312, the first comparison unit 313, the first coordinate correction unit 314, and the first data compensation unit 315.

The first afterimage detection unit 311 may receive an input image and detect the first afterimage area AIA1 including the afterimage AI in the first display area DA1 (operation S410). The first afterimage detection unit 311 may detect the number of afterimage pixels and the coordinates of the afterimage pixels in the first afterimage area AIA1. The first afterimage detection unit 311 may provide the afterimage detection result of the first afterimage area AIA1 to the first communication unit 312.

The first communication unit 312 may not perform wired or wireless communication with the second to fourth communication units 322, 332, and 342. The first communication unit 312 may provide the afterimage detection result of the first afterimage area AIA1 to the first comparison unit 313.

The first comparison unit 313 may compare a distance between the first afterimage area AIA1 and the boundary line BND between the first and second display areas DA1 and DA2 with a preset reference distance (operation S420). For example, when the distance between the boundary line BND and the first afterimage area AIA1 is smaller than the reference distance, the first comparison unit 313 may transmit an afterimage correction signal to the first coordinate correction unit 314.

The first coordinate correction unit 314 may receive the afterimage correction signal and correct the coordinates of the first afterimage area AIA1 (operation S430). The first coordinate correction unit 314 may extend the coordinates in the first direction (X-axis direction) of the first afterimage area AIA1 to the boundary line BND. The first coordinate correction unit 314 may provide the coordinates of a corrected afterimage area CIA to the first data compensation unit 315.

The first data compensation unit 315 may generate a compensation data voltage by adjusting the saturation or luminance of the corrected afterimage area CIA (operation S440).

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random-access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present invention.

What is claimed is:

1. A display device comprising:

a display panel comprising first and second display areas adjacent to each other; and first and second data drivers configured to drive the first and second display areas, respectively, wherein the first data driver comprises:

a first afterimage detector configured to receive an input image and to detect a first afterimage area including an afterimage of the first display area from a portion of the input image corresponding to the first display area;

a second afterimage detector configured to receive the input image and to detect a second afterimage area including an afterimage of the second display area from a portion of the input image corresponding to the second display area;

a first comparator configured to compare an afterimage detection result of the first display area with an afterimage detection result of the second display area received from the second data driver; and a first coordinate corrector configured to correct coordinates of the first afterimage area in response to the afterimage detection result of the first display area and the afterimage detection result of the second display area satisfying a preset reference.

2. The display device of claim 1, wherein the second data driver comprises:

a second comparator configured to compare the afterimage detection result of the second display area with the afterimage detection result of the first display area; and a second coordinate corrector configured to correct coordinates of the second afterimage area in response to the afterimage detection result of the second display area and the afterimage detection result of the first display area satisfying a preset reference.

3. The display device of claim 2, wherein the first data driver is configured to transmit the afterimage detection result of the first display area to the second data driver, and to receive the afterimage detection result of the second display area from the second data driver.

4. The display device of claim 2, wherein the display panel further comprises a third display area adjacent to the second display area, the display device further comprising a third data driver configured to drive the third display area, wherein the third data driver comprises:

a third afterimage detector configured to detect a third afterimage area including an afterimage of the third display area;

a third comparator configured to compare an afterimage detection result of the third display area with the afterimage detection result of the second display area; and a third coordinate corrector configured to correct coordinates of the third afterimage area in response to the afterimage detection result of the third display area and the afterimage detection result of the second display area satisfying a preset reference.

5. The display device of claim 4, wherein the second data driver further comprises a communication unit configured to determine whether or not to receive the afterimage detection result from the first data driver and the third data driver, and in response to the second data driver receiving the afterimage detection result from each of the first and third data drivers through the communication unit, the second data driver is configured to compare the afterimage detection result of the second display area with the afterimage detection result of each of the first and third display areas.

6. The display device of claim 5, wherein in response to the second data driver not receiving the afterimage detection result from one of the first and third data drivers, the second data driver is configured to compare the afterimage detection result of the second display area with the afterimage detection result received from the other one of the first and third data drivers.

7. The display device of claim 2, wherein the first afterimage detector comprises:

a type determination module configured to determine a type of the afterimage in the first afterimage area;

an afterimage detection module configured to detect an existence probability of the afterimage in the first afterimage area; and a coordinate detection module configured to detect the coordinates of the first afterimage area.

8. The display device of claim 7, wherein the first comparator comprises:

a type comparison module configured to compare the type of the afterimage in the first afterimage area with a type of the afterimage in the second afterimage area;

a probability comparison module configured to compare the existence probability of the afterimage in the first afterimage area with an existence probability of the afterimage in the second afterimage area; and a coordinate comparison module configured to compare the coordinates of the first afterimage area with the coordinates of the second afterimage area.

9. The display device of claim 8, wherein the probability comparison module is configured to compare the existence probability of the afterimage in each of the first and second afterimage areas with a preset reference probability, and to compare a difference in afterimage existence probabilities of the first and second afterimage areas with a preset reference error.

10. The display device of claim 8, wherein the coordinate comparison module is configured to compare at least one of a coordinate difference in a first direction between the first and second afterimage areas, a coordinate difference in a second direction between upper ends of the first and second afterimage areas, or a coordinate difference in the second direction between lower ends of the first and second afterimage areas.

11. The display device of claim 7, wherein the first coordinate corrector is configured to extend the coordinates in a first direction of the first afterimage area to a boundary line between the first display area and the second display area, and to adjust the coordinates in a second direction of the first afterimage area to an average value of the coordinates in the second direction of the first afterimage area and the coordinates in the second direction of the second afterimage area.

12. The display device of claim 7, wherein the first coordinate corrector is configured to extend the coordinates in a first direction of the first afterimage area to a boundary line between the first display area and the second display area, and to adjust the coordinates in a second direction of the first afterimage area to a larger value of upper coordinates in the second direction of the first and second afterimage areas, or a smaller value of lower coordinates in the second direction of the first and second afterimage areas.

13. The display device of claim 2, wherein the first afterimage detector is configured to detect a number of afterimage pixels in the first display area and coordinates of the afterimage pixels.

14. The display device of claim 13, wherein the first comparator is configured to compare a sum of the number of afterimage pixels in a first comparison target area of the first display area and a second comparison target area of the second display area in contact with a boundary line between the first display area and the second display area with a preset reference number.

15. The display device of claim 14, wherein a length of the first comparison target area in a first direction has a constant value with respect to the boundary line, and a length of the first comparison target area in a second direction is determined based on upper and lower ends of the first afterimage area and upper and lower ends of the second afterimage area.

16. The display device of claim 13, wherein the first coordinate corrector is configured to extend the coordinates in a first direction of the first afterimage area to a boundary line.

17. A display device comprising:

a display panel comprising first and second display areas adjacent to each other; and first and second data drivers configured to drive the first and second display areas, respectively, wherein the first data driver comprises:

a first afterimage detector configured to receive an input image and to detect a first afterimage area within the first display area including an afterimage of the first display area from the input image;

a first comparator configured to compare a distance between a boundary line between the first display area and the second display area and the first afterimage area with a preset reference distance; and a first coordinate corrector configured to correct coordinates of the first afterimage area in response to the distance between the boundary line and the first afterimage area satisfying a preset reference number.

18. The display device of claim 17, wherein the second data driver comprises:

a second afterimage detector configured to detect a second afterimage area including an afterimage of the second display area;

a second comparator configured to compare a distance between the boundary line and the second afterimage area with a preset reference distance; and a second coordinate corrector configured to correct coordinates of the second afterimage area in response to the distance between the boundary line and the second afterimage area satisfying the preset reference number.

19. The display device of claim 17, wherein in response to a distance between the boundary line and the first afterimage area being smaller than a preset reference distance, the first comparator is configured to transmit an afterimage correction signal to the first coordinate corrector.

20. The display device of claim 19, wherein in response to the first coordinate corrector receiving the afterimage correction signal, the first coordinate corrector is configured to extend the coordinates of the first afterimage area to the boundary line.

* * * * *